US009964886B2

(12) United States Patent
Matsushima et al.

(10) Patent No.: US 9,964,886 B2
(45) Date of Patent: May 8, 2018

(54) ELECTROSTATIC LATENT IMAGE DEVELOPING CORE-SHELL TYPE TONER, METHOD FOR MANUFACTURING SAME, AND IMAGE FORMING METHOD USING SAME

(71) Applicant: Konica Minolta, Inc., Tokyo (JP)

(72) Inventors: Kaori Matsushima, Hino (JP); Tomomi Oshiba, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/270,664

(22) Filed: Sep. 20, 2016

(65) Prior Publication Data

US 2017/0269490 A1 Sep. 21, 2017

(30) Foreign Application Priority Data

Mar. 16, 2016 (JP) ..... 2016-053025

(51) Int. Cl.
*G03G 9/093* (2006.01)

(52) U.S. Cl.
CPC ..... *G03G 9/09371* (2013.01); *G03G 9/09321* (2013.01); *G03G 9/09328* (2013.01); *G03G 9/09392* (2013.01)

(58) Field of Classification Search
CPC ..... G03G 9/09371; G03G 9/09328; G03G 9/09321; G03G 9/09392; G03G 13/20
See application file for complete search history.

(56) References Cited

U.S. PATENT DOCUMENTS

| | | | | |
|---|---|---|---|---|
| 5,677,100 | A * | 10/1997 | Asano | G03G 9/09392 430/110.2 |
| 9,436,111 | B1 * | 9/2016 | Yoshida | G03G 9/09371 |
| 9,612,545 | B2 * | 4/2017 | Bejat | G03G 9/09328 |
| 2013/0330667 | A1 * | 12/2013 | Fukuri | G03G 9/09328 430/110.2 |
| 2016/0154333 | A1 * | 6/2016 | Sun | G03G 9/09371 430/108.6 |
| 2017/0010547 | A1 * | 1/2017 | Bejat | G03G 9/09328 |
| 2017/0010549 | A1 * | 1/2017 | Bejat | G03G 9/09371 |

FOREIGN PATENT DOCUMENTS

JP 2011053494 A 3/2011

* cited by examiner

*Primary Examiner* — Christopher D Rodee
(74) *Attorney, Agent, or Firm* — Lucas & Mercanti, LLP

(57) ABSTRACT

Provided is an electrostatic latent image developing toner that, while ensuring low temperature fixability, can ensure image quality stability even during high-speed continuous printing. The toner is an electrostatic latent image developing core-shell type toner containing at least a binder resin. The binder resin includes a crystalline polyester resin, an amorphous polyester resin, and a hybrid amorphous vinyl resin in which a vinyl polymerization segment is chemically bonded to a polymerization segment other than the vinyl polymerization segment, in which a core portion of the toner contains the crystalline polyester resin and the amorphous polyester resin, whereas a shell portion of the toner contains the hybrid amorphous vinyl resin, and the hybrid amorphous vinyl resin has a vinyl polymerization segment content of from 51 to 99% by mass.

13 Claims, No Drawings

ELECTROSTATIC LATENT IMAGE DEVELOPING CORE-SHELL TYPE TONER, METHOD FOR MANUFACTURING SAME, AND IMAGE FORMING METHOD USING SAME

CROSS-REFERENCE TO RELATED APPLICATION

This application is based on Japanese Patent Application No. 2016-053025 filed on Mar. 16, 2016, the contents of which are incorporated herein by reference.

BACKGROUND

1. Technical Field

The present invention relates to an electrostatic latent image developing core-shell type toner, a method for manufacturing the toner, and an image forming method using the toner.

2. Description of Related Art

Recently, low temperature fixability of toner has been improved in order to suppress power consumption while achieving high-speed printing and expansion of media adaptability. However, with mere use of a resin that is melted at low temperature, durability at normal temperature cannot be maintained, and problems occur, such as toner blocking and image sticking. To prevent such problems, toners have been developed that use a polyester resin having high glass transition point and low softening point to lower resin melting temperature and simultaneously to maintain high glass transition point so as to be able to provide both low temperature fixability and strengths of toner particles and images against physical stresses at normal temperature. On the other hand, in terms of speeding up printing, there is an increasing need to ensure image quality stability during continuous printing, and toner, after having been supplied into a developing unit, is desired to be quickly electrically charged and allowed to reach a portion to be developed.

As an example of a technique for ensuring such image quality stability during continuous printing, Patent Literature 1 proposes a binder resin for an electrophotographic toner. It is a toner binder resin composed of a resin obtained by subjecting a crystalline resin containing aqueous dispersion solution and an amorphous resin containing aqueous dispersion solution to an aggregation step and a coalescence step. The crystalline resin is a composite resin that includes a polycondensation-based resin component obtained by polycondensation of an alcohol component that contains an aliphatic diol having 2 to 10 carbon atoms and a carboxylic acid component, and a styrene-based resin component.

Patent Literature 1 is Japanese Patent Application Laid-open No. 2011-053494.

SUMMARY

The technique disclosed in Patent Literature 1 above is described to allow for uniform and fine dispersion of the crystalline resin into the amorphous resin, to suppress image fogging, and to provide excellent image glossiness while maintaining low temperature fixability. However, there is a problem in that due to slow start of toner charging in the developing unit, image quality stability during high-speed continuous printing cannot be ensured.

The present inventors repeatedly conducted intensive and extensive studies, and consequently found that the above problem can be solved by an electrostatic latent image developing core-shell type toner that includes a crystalline polyester resin and an amorphous polyester resin in a core portion and a hybrid amorphous vinyl resin in a shell portion, and in which the hybrid amorphous vinyl resin has a vinyl polymerization segment content in a specific range, thereby accomplishing the invention.

To achieve at least one of the abovementioned objects, an electrostatic latent image developing core-shell type toner reflecting one aspect of the present invention contains at least a binder resin, in which the binder resin includes a crystalline polyester resin, an amorphous polyester resin, and a hybrid amorphous vinyl resin in which a vinyl polymerization segment is chemically bonded to a polymerization segment other than the vinyl polymerization segment, a core portion of the toner contains the crystalline polyester resin and the amorphous polyester resin, whereas a shell portion of the toner contains the hybrid amorphous vinyl resin, and the hybrid amorphous vinyl resin has a vinyl polymerization segment content of from 51 to 99% by mass.

In the above toner, the hybrid amorphous vinyl resin preferably has a vinyl polymerization segment content of from 65 to 90% by mass.

In the above toner, the polymerization segment other than the vinyl polymerization segment is preferably a polyester polymerization segment.

In the above toner, the hybrid amorphous vinyl resin is preferably a hybrid amorphous vinyl resin that includes the vinyl polymerization segment as a main chain and the polymerization segment other than the vinyl polymerization segment as a side chain.

In the above toner, the crystalline polyester resin is preferably unmodified.

In the above toner, the crystalline polyester resin preferably includes a hybrid crystalline polyester resin in which a crystalline polyester polymerization segment is chemically bonded to an amorphous polyester polymerization segment or a vinyl polymerization segment.

In the above toner, the binder resin preferably has a crystalline polyester resin content of from 3 to 30% by mass.

In the above toner, the binder resin preferably has a crystalline polyester resin content of from 5 to 25% by mass.

In the above toner, the binder resin preferably has a hybrid amorphous vinyl resin content of from 5 to 30% by mass.

In the above toner, the amorphous polyester resin preferably includes an unsaturated aliphatic polyhydric carboxylic acid component.

In the above toner, the total number of carbon atoms of a polyhydric alcohol component constituting the crystalline polyester resin and carbon atoms of a polyhydric carboxylic acid component constituting the crystalline polyester resin is preferably an odd number.

In the above toner, an absolute value of a difference between the number of carbon atoms of a polyhydric alcohol component and the number of carbon atoms of a polyhydric carboxylic acid component constituting the crystalline polyester resin is preferably equal to or more than 3.

DETAILED DESCRIPTION

Hereinafter, embodiments of the present invention will be described. However, it should be noted the invention is not limited only to the following embodiments. Additionally, in the present specification, "X to Y" that indicates a range means "to be equal to or more than X and equal to or less than Y". In addition, operation, measurements of physical properties, and the like are performed under conditions with a room temperature of from 20 to 25° C. and a relative humidity of from 40 to 50% RH unless otherwise specified.

In addition, in the present specification, "electrostatic latent image developing core-shell type toner" may be simply referred to as "toner".

An embodiment of the invention is an electrostatic latent image developing core-shell type toner that is an electrostatic latent image developing core-shell type toner containing at least a binder resin, in which the binder resin includes a crystalline polyester resin, an amorphous polyester resin, and a hybrid amorphous vinyl resin obtained by chemically bonding a vinyl polymerization segment to a polymerization segment other than the vinyl polymerization segment, a core portion of the toner contains the crystalline polyester resin and the amorphous polyester resin, whereas a shell portion of the toner contains the hybrid amorphous vinyl resin, and the hybrid amorphous vinyl resin has a vinyl polymerization segment content of from 51 to 99% by mass.

Having the structure thus described can provide an electrostatic latent image developing core-shell type toner that, while ensuring low temperature fixability, can ensure image quality stability even during high-speed continuous printing.

Regarding the reason that the toner of the invention can provide the above advantageous effect, an expression mechanism and an action mechanism thereof are not clarified. However, the mechanisms are inferred as follows.

By including the crystalline polyester resin and the amorphous polyester resin in the core portion, the crystalline polyester resin and the amorphous polyester resin become compatible with each other and promote thermofusion, and the vinyl polymerization segment included in the hybrid amorphous vinyl resin of the shell portion promotes fusion between toner particles. Thereby, low temperature fixability is improved. Furthermore, the vinyl polymerization segment having a different structure from the polyester resins is present on a toner surface side and can inhibit the crystalline polyester resins of the core portion that tend to hinder charging from being exposed onto the toner surface. This improves toner chargeability. Thus, even during high-speed continuous printing, toner particles in a developer are uniformly and quickly electrically charged and thereby can move to surfaces of a photoreceptor, a transfer member, and the like with fidelity with respect to development and transfer biases, so that image quality stability can be ensured.

However, the above mechanisms are those inferred, and it is to be understood that the invention is not limited to the above mechanisms at all.

Hereinafter, the electrostatic latent image developing core-shell type toner of the invention will be described in detail. In addition, the "toner" according to the invention contains "toner matrix particles". The "toner matrix particles" are referred to as "toner particles" by addition of an external additive. Then, the "toner" means an aggregate of "toner particles".

[Binder Resin]

The binder resin according to the invention includes a crystalline polyester resin, an amorphous polyester resin, and a hybrid amorphous vinyl resin including a vinyl polymerization segment and a polymerization segment other than the vinyl polymerization segment. The toner of the invention includes the crystalline polyester resin and the amorphous polyester resin in the core portion, and includes the hybrid amorphous vinyl resin in the shell portion.

A mass ratio (amorphous resin/crystalline resin) of the amorphous resin to the crystalline resin in the binder resin is preferably from 99/1 to 65/35, more preferably from 98/2 to 65/35, still more preferably from 97/3 to 70/30, and particularly preferably from 95/5 to 75/25. When the mass ratio (amorphous resin/crystalline resin) is in the above range, the crystalline resin is not exposed onto surfaces of the toner particles, or even if exposed, the amount of the resin exposed is very small, so that image quality stability is improved. Additionally, the crystalline resin that has such an amount that can improve low temperature fixability can be introduced in the toner particles. In addition, in this case, the mass of the amorphous resin indicates a total mass of the amorphous polyester resin and the hybrid amorphous vinyl resin in the binder resin, and the mass of the crystalline resin indicates a mass of the crystalline polyester resin in the binder resin.

The toner of the invention may additionally include a well-known toner binder resin different from the resins included in the binder resin of the invention, for example, a resin such as a vinyl resin such as a styrene-acrylic resin, an epoxy resin, a polycarbonate resin, or a polyurethane resin, as long as the advantageous effect of the invention is not deteriorated.

<Crystalline Polyester Resin>

The crystalline polyester resin is not particularly limited, and any crystalline polyester resin well-known in the present technical field can be used. Herein, the "crystalline polyester resin" refers to one among well-known polyester resins obtained by polycondensation reactions between di- or higher polyhydric carboxylic acids (polyhydric carboxylic acid components) and di- or higher polyhydric alcohols (polyhydric alcohol components) that does not have a stepwise endothermic change but has a definite endothermic peak in differential scanning calorimetry (DSC). The definite endothermic peak specifically refers to a peak at which when measured at a temperature increase rate of 10° C./min in differential scanning calorimetry (DSC), the endothermic peak has a half value width of not more than 15° C.

Polyhydric Carboxylic Acid Component

The polyhydric carboxylic acid component is a compound including two or more carboxyl groups in one molecule. Specific examples thereof include saturated aliphatic dicarboxylic acids such as oxalic acid, malonic acid, succinic acid, adipic acid, sebacic acid, azelaic acid, n-dodecyl succinic acid, nonanedicarboxylic acid, decanedicarboxylic acid (dodecane dioic acid), undecanedicarboxylic acid, dodecanedicarboxylic acid (tetradecane dioic acid), and tetradecanedicarboxylic acid; alicyclic dicarboxylic acids such as cyclohexane dicarboxylic acid; aromatic dicarboxylic acids such as phthalic acid, isophthalic acid, and terephthalic acid; tri- or higher polyhydric carboxylic acids such as trimellitic acid and pyromellitic acid; anhydrides of these carboxylic acid compounds; and alkyl esters having 1 to 3 carbon atoms. These compounds may be used singly or in combination of two or more kinds thereof.

Polyhydric Alcohol Component

The polyhydric alcohol component is a compound including two or more hydroxyl groups in one molecule. Specific examples thereof include aliphatic diols such as 1,2-propane diol, 1,3-propane diol, 1,4-butane diol, 1,5-pentane diol, 1,6-hexane diol, 1,7-heptane diol, 1,8-octane diol, 1,9-nonane diol, dodecane diol, neopentyl glycol, and 1,4-butene diol; and tri- or higher polyhydric alcohols such as glycerin, pentaerythritol, trimethylolpropane, and sorbitol. These may be used singly or in combination of two or more kinds thereof.

The crystalline polyester resin may be a resin that is formed by chemically bonding a crystalline polyester polymerization segment to another polymerization segment.

For example, the resin may be a styrene-acrylic modified polyester resin having a crystalline block copolymer structure.

The total number of carbon atoms of the polyhydric alcohol component constituting the crystalline polyester resin and carbon atoms of the polyhydric carboxylic acid component constituting the crystalline polyester resin is preferably an odd number. Additionally, an absolute value of a difference between the number of the carbon atoms of the polyhydric alcohol component and the number of the carbon atoms of the polyhydric carboxylic acid component constituting the crystalline polyester resin is preferably equal to or more than 1 and more preferably equal to or more than 3. In a crystalline polyester resin including such a polyhydric alcohol component and such a polyhydric carboxylic acid component, even when molecules are arranged in an alkylene chain portion, a carboxyl group or a hydroxyl group at a molecular chain terminal easily disorders the sequence. Thus, the molecular sequence seems to be easily unbound even when the resin is crystallized. As a result of that, the molecular chain of the crystalline polyester resin is easily entangled with the molecular chain of the amorphous polyester resin, and therefore, compatibility is promoted, thereby improving low temperature fixability.

In addition, when the crystalline polyester resin includes two or more polyhydric alcohol components, "the number of carbon atoms of the polyhydric alcohol component" indicates the number of carbon atoms of a polyhydric alcohol component whose content is the largest. In a case in which the amounts thereof are the same, the number of carbon atoms of a polyhydric alcohol component having a largest number of carbon atoms is designated as "the number of carbon atoms of the polyhydric alcohol component".

Similarly, when two or more polyhydric carboxylic acid components are included, "the number of carbon atoms of the polyhydric carboxylic acid component" indicates the number of carbon atoms of a polyhydric carboxylic acid component whose content is the largest. When the amounts thereof are the same, the number of carbon atoms of a polyhydric carboxylic acid component having a largest number of carbon atoms is designated as "the number of carbon atoms of the polyhydric carboxylic acid component".

Melting Point (Tc) of Crystalline Polyester Resin

The crystalline polyester resin has a melting point (Tc) of preferably from 55 to 90° C., and more preferably from 65 to 85° C. When the melting point of the crystalline polyester resin is in the above range, sufficient low temperature fixability can be obtained. In addition, the melting point of the crystalline polyester resin can be controlled by the kinds and amounts of monomer components.

In the present invention, the melting point of the crystalline polyester resin is a value measured as follows. Specifically, using a differential scanning calorimeter "Diamond DSC" (manufactured by Perkin Elmer Co., Ltd.), measurement is performed under measurement conditions (temperature increase and cooling conditions) of going through a first temperature increase process of increasing a temperature from 0° C. to 200° C. at a temperature increase rate of 10° C./min, a cooling process of cooling from 200° C. to 0° C. at a cooling rate of 10° C./min, and a second temperature increase process of increasing a temperature from 0° C. to 200° C. at the temperature increase rate of 10° C./min in this order. On the basis of a DSC curve obtained by the measurement, an endothermic peak top temperature derived from the crystalline polyester resin in the first temperature increase process is designated as a melting point (Tc). In measurement steps, 3.0 mg of a measurement sample (crystalline polyester resin) is encapsulated in an aluminum pan, and the pan is placed on a sample holder of the Diamond DSC. A vacant aluminum pan is used for a reference sample.

Weight Average Molecular Weight and Number Average Molecular Weight of Crystalline Polyester Resin A molecular weight of the crystalline polyester resin measured by gel permeation chromatography (GPC) is preferably from 4,500 to 50, 000 and more preferably from 5,000 to 50, 000 in terms of weight average molecular weight (Mw), and preferably from 1,500 to 25,000 in terms of number average molecular weight (Mn). When the molecular weight thereof is in the ranges, low temperature fixability can be exerted.

The Mw and the Mn of the crystalline polyester resin indicate values measured as follows. Specifically, using an apparatus "HLC-8120 GPC" (manufactured by Tosoh Corporation) and columns "TSK guard column+TSKgel Super HZ-M (3 columns in series)" (manufactured by Tosoh Corporation), tetrahydrofuran (THF) as a carrier solvent is allowed to flow at a flow rate of 0.2 mL/min while maintaining a column temperature at 40° C., and a measurement sample is dissolved in the tetrahydrofuran so as to have a concentration of 1 mg/ml under dissolution conditions where the measurement sample is subjected to a 5-minute treatment using an ultrasonic disperser at room temperature. Next, the resulting solution is filtered through a membrane filter with a pore size of 0.2 μm to obtain a sample solution, and 10 μL of the sample solution and the above carrier solvent are injected together in the apparatus to perform detection using a refractive index detector (RI detector). Then, a molecular weight distribution of the measurement sample is calculated by a calibration curve measured using monodisperse polystyrene standard particles. Ten kinds of polystyrene standard particles are used for the calibration curve measurement.

The binder resin has a crystalline polyester resin content of preferably from 1 to 35% by mass, more preferably from 2 to 35% by mass, still more preferably from 3 to 30% by mass, and particularly preferably from 5 to 25% by mass. When the crystalline polyester resin content is in the above range, low temperature fixability can be exerted.

<Amorphous Polyester Resin>

The amorphous polyester resin is a resin among well-known polyester resins obtained by polycondensation reactions between di- or higher polyhydric carboxylic acid components (polyhydric carboxylic acid components) and di- or higher polyhydric alcohol components (polyhydric alcohol components) that does not have a definite melting point and has a relatively high glass transition point (Tg). This matter can be confirmed by performing differential scanning calorimetry (DSC) on the amorphous polyester resin. In addition, since monomer components thereof are different from those constituting the crystalline polyester resin, the amorphous polyester resin can be distinguished from the crystalline polyester resin, for example, by analysis such as NMR.

The amorphous polyester resin is not particularly limited, and any amorphous polyester resin conventionally well-known in the present technical field can be used.

Polyhydric Carboxylic Acid Component

Preferable examples of the polyhydric carboxylic acid component to be used include unsaturated aliphatic polyhydric carboxylic acids, aromatic polyhydric carboxylic acids, and derivatives thereof. Any saturated aliphatic polyhydric carboxylic acid may be used together as long as an amorphous resin can be formed.

Examples of the unsaturated aliphatic polyhydric carboxylic acids include unsaturated aliphatic dicarboxylic acids such as methylene succinic acid, fumaric acid, maleic acid, 3-hexene dioic acid, 3-octene dioic acid, and succinic acid substituted with an alkyl group having 1 to 20 carbon atoms or an alkenyl group having 2 to 20 carbon atoms; unsaturated aliphatic tricarboxylic acids such as 3-butene-1,2,3-tricarboxylic acid, 4-pentene-1,2,4-tricarboxylic acid, and aconitic acid; and unsaturated aliphatic tetracarboxylic acids such as 4-pentene-1,2,3,4-tetracarboxylic acid. Additionally, lower alkyl esters and acid anhydrides thereof may be used.

Specific examples of the succinic acid substituted with an alkyl group having 1 to 20 carbon atoms or an alkenyl group having 2 to 20 carbon atoms include dodecyl succinic acid, dodecenyl succinic acid, octenyl succinic acid, and decenyl succinic acid. Additionally, lower alkyl esters and acid anhydrides thereof may be used.

Examples of the aromatic polyhydric carboxylic acids include aromatic dicarboxylic acids such as phthalic acid, terephthalic acid, isophthalic acid, t-butyl isophthalic acid, tetrachlorophthalic acid, chlorophthalic acid, nitrophthalic acid, p-phenylene diacetic acid, 2,6-naphthalene dicarboxylic acid, 4,4'-biphenyl dicarboxylic acid, and anthracenedicarboxylic acid; aromatic tricarboxylic acids such as 1,2,4-benzene tricarboxylic acid (trimellitic acid), 1,2,5-benzene tricarboxylic acid (trimesic acid), 1,2,4-naphthalene tricarboxylic acid, and hemimellitic acid; aromatic tetracarboxylic acids such as pyromellitic acid and 1,2,3,4-butane tetracarboxylic acid; and aromatic hexacarboxylic acids such as mellitic acid. Additionally, lower alkyl esters and acid anhydrides thereof may be used.

Examples of the saturated aliphatic polyhydric carboxylic acids include the saturated aliphatic dicarboxylic acids mentioned in the section of <Crystalline Polyester Resin>.

The number of carbon atoms of the dicarboxylic acid is not particularly limited, but preferably from 1 to 20, more preferably from 2 to 15, and particularly preferably from 3 to 12, in terms of easily optimizing heat characteristics. The dicarboxylic acid is not limited to one kind, and two or more kinds of dicarboxylic acids may be mixed for use.

The number of carbon atoms of the tri- or higher polyhydric carboxylic acids is not particularly limited, but preferably from 3 to 20, more preferably from 5 to 15, and particularly preferably from 6 to 12, particularly in terms of easily optimizing heat characteristics. The polyhydric carboxylic acid component is not limited to one kind, and two or more kinds of polyhydric carboxylic acid components may be mixed for use.

Polyhydric Alcohol Component

Preferable examples of the polyhydric alcohol component to be used include unsaturated aliphatic polyhydric alcohols, aromatic polyhydric alcohols, and derivatives thereof, from the viewpoint of chargeability and toner strength. Any saturated aliphatic polyhydric alcohol may be used together as long as an amorphous polyester resin can be formed.

Examples of the unsaturated aliphatic polyhydric alcohols include unsaturated aliphatic diols such as 2-butene-1,4-diol, 3-butene-1,4-diol, 2-butyne-1,4-diol, 3-butyne-1,4-diol, and 9-octadecene-7, 12-diol. In addition, examples of the saturated aliphatic polyhydric alcohols include glycerin, trimethylolpropane, pentaerythritol, and sorbitol. Furthermore, derivatives thereof may also be used.

Examples of the aromatic polyhydric alcohols include bisphenols such as bisphenol A and bisphenol F and alkylene oxide adducts of bisphenols, such as ethylene oxide adducts and propylene oxide adducts thereof, 1,3,5-benzene triol, 1,2,4-benzene triol, and 1,3,5-trihydroxymethyl benzene, and derivatives thereof may also be used. Particularly, among them, bisphenol A-based compounds such as ethylene oxide adducts and propylene oxide adducts of bisphenol A are preferably used from the viewpoint of improving charging uniformity in the toner and easily optimizing heat characteristics.

The polyhydric alcohol component is not limited to one kind, and two or more kinds thereof may be mixed for use.

The number of carbon atoms of the tri- or higher polyhydric alcohols is not particularly limited, but preferably from 3 to 20, particularly, in terms of easily optimizing heat characteristics.

The amorphous polyester resin may be a resin formed by chemically bonding an amorphous polyester polymerization segment to another polymerization segment. Examples of the resin include amorphous styrene-acrylic modified polyester resins. Herein, the term "styrene-acrylic modified polyester resins" refer to resins including polyester molecules of a block copolymer structure in which a styrene-acrylic copolymer molecular chain (a polymerization segment composed of a styrene-acrylic copolymer) is molecular-bound with an amorphous polyester molecular chain (an amorphous polyester polymerization segment).

The amorphous polyester resin preferably includes an unsaturated aliphatic polyhydric carboxylic acid component as the polyhydric carboxylic acid component. Such an amorphous polyester resin further promotes compatibility with the crystalline polyester resin, so that low temperature fixability is improved.

The amorphous polyester resin has a glass transition point (Tg) of preferably from 30 to 80° C., and more preferably from 40 to 64° C. In addition, the glass transition point (Tg) can be measured by differential scanning calorimetry (DSC), and specifically is a value measured using "Diamond DSC" (manufactured by Perkin Elmer Co., Ltd). Measurement steps and measurement conditions are the same as those for the melting point of the above crystalline polyester resin. An analysis is made on the basis of data of the second temperature increase process. An extension line of a base line before rising of a first endothermic peak and a tangential line indicating a maximum inclination in a range from a rising portion of the first peak to a peak top are drawn, and an intersection point between the lines is designated as the glass transition point.

A molecular weight measured by gel permeation chromatography (GPC) of the amorphous polyester resin is preferably from 5,000 to 25,000 and more preferably from 5,000 to 20,000 in terms of weight average molecular weight (Mw), and preferably from 2,000 to 50,000 in terms of number average molecular weight (Mn). When the molecular weight is in these ranges, an advantage can be obtained in that low temperature fixability can be ensured. The measurement method to be employed is the same as the method in the crystalline polyester resin.

In addition, the amorphous polyester resin has a softening point (Tsc) of preferably from 80 to 120° C., and more preferably from 85 to 110° C. When the softening point (Tsc) is in the range, an advantage can be obtained in that low temperature fixability can be secured. In addition, the softening point can be measured by a method described in Examples.

The method for manufacturing the crystalline polyester resin and the amorphous polyester resin is not particularly limited. The resins can be manufactured by polycondensation (esterification) of any of the polyhydric carboxylic acid components and any of the polyhydric alcohol components described above using a well-known esterification catalyst.

A usage ratio between the polyhydric carboxylic acid component and the polyhydric alcohol component is not particularly limited, but an equivalent ratio [OH]/[COOH] between hydroxyl groups [OH] of the polyhydric alcohol component and carboxylic groups [COOH] of the polyhydric carboxylic acid component is preferably from 1.5/1 to 1/1.5, and more preferably from 1.2/1 to 1/1.2.

Examples of catalysts usable in manufacturing the resins include alkali metal compounds such as sodium and lithium; compounds including elements in Group II such as magnesium and calcium; metal compounds such as aluminum, zinc, manganese, antimony, titanium, tin, zirconium, and germanium; phosphorous acid compounds; phosphoric acid compounds; and amine compounds. Specifically, examples of tin compounds include dibutyltin oxide, octyltin oxide, dioctyltin oxide, and salts thereof. Examples of titanium compounds include titanium alkoxides such as tetra-normal-butyl titanate, tetra-tertiary-butyl titanate, tetra-isopropyl titanate, tetra-methyl titanate, and tetra-stearyl titanate; titanium acylates such as polyhydroxy titanium stearate; and titanium chelates such as titanium tetraacetyl acetonate, titanium lactate, titanium triethanol aminate. Examples of germanium compounds include germanium dioxides. In addition, examples of the aluminum compounds include oxides such as polyhydroxylated aluminum, aluminum alkoxides, and tributyl aluminate. These may be used singly or in combination of two or more kinds thereof.

The temperature of polycondensation (esterification) is not particularly limited, but preferably from 150 to 250° C. In addition, the time of polycondensation (esterification) is not particularly limited, but preferably from 0.5 to 30 hours. During polycondensation, the inside of the reaction system may be decompressed if necessary.

The crystalline polyester resin may be in a form not composited with another resin, i.e., may be unmodified. An unmodified crystalline polyester resin is not compatible with the vinyl polymerization segment of the hybrid amorphous vinyl resin present in the shell portion. Thus, the crystalline polyester resin does not excessively effuse from the core portion onto a shell portion surface, so that the crystalline polyester resin is more surely included in the core portion. Accordingly, since charging failure in the toner can be suppressed, image quality stability during high-speed continuous printing can be ensured. Furthermore, the inclusion of 51 to 99% by mass of the vinyl polymerization segment content in the hybrid amorphous vinyl resin can surely suppress the phenomenon of excessive effusion of the crystalline polyester resin from the core portion onto the shell portion surface. As a result of that, since the toner is uniformly electrically charged in a short time, image quality stability during high-speed continuous printing can be ensured.

The crystalline polyester resin may contain a hybrid crystalline polyester resin having a graft copolymer structure in which a crystalline polyester polymerization segment is chemically bonded to an amorphous polyester polymerization segment or a vinyl polymerization segment. With such a structure as above, the crystalline polyester resin is appropriately compatible with the amorphous polyester resin present in the core portion, and does not excessively effuse from the core portion onto the shell portion surface, so that that the crystalline polyester resin is more surely included in the core portion. Accordingly, since charging failure in the toner can be suppressed, image quality stability during high-speed continuous printing can be ensured. Furthermore, the inclusion of 51 to 99% by mass of the vinyl polymerization segment content in the hybrid amorphous vinyl resin can surely suppress the phenomenon of excessive effusion of the crystalline polyester resin from the core portion onto the shell portion surface. As a result of that, since the toner is uniformly electrically charged in a short time, image quality stability during high-speed continuous printing can be ensured. The crystalline polyester polymerization segment and the amorphous polyester polymerization segment constituting the hybrid crystalline polyester resin are formed of a crystalline polyester resin and an amorphous polyester resin manufactured by performing a polycondensation reaction between a polyhydric carboxylic acid and a polyhydric alcohol in the presence of a catalyst. Herein, specific kinds of the polyhydric carboxylic acid component and the polyhydric alcohol component are the same as those described above, and thus descriptions thereof will be omitted here. The vinyl polymerization segment is formed of a resin obtained by polymerizing a vinyl monomer. Herein, the vinyl monomers are the same as those used in a vinyl polymerization segment constituting the hybrid amorphous vinyl resin that will be described later, and thus a description thereof will be omitted here.

The crystalline polyester polymerization segment and the amorphous polyester polymerization segment in the hybrid crystalline polyester resin are preferably bound to each other via a bireactive monomer.

In addition, the amorphous polyester resin may include a hybrid amorphous polyester resin having a graft copolymer structure that is formed by chemical bonding between a vinyl polymerization segment and an amorphous polyester polymerization segment. In this case, the vinyl polymerization segment and the amorphous polyester polymerization segment are preferably bonded to each other via a bireactive monomer.

The vinyl polymerization segment is formed of a resin obtained by polymerizing one or more vinyl monomer. Herein, the vinyl monomers are the same as those used for the vinyl polymerization segment constituting the hybrid amorphous vinyl resin, which will be described later, and thus a description thereof will be omitted here. The crystalline polyester polymerization segment constituting the hybrid crystalline polyester resin is formed of a crystalline polyester resin manufactured by performing a polycondensation reaction between a polyhydric carboxylic acid and a polyhydric alcohol in the presence of a catalyst. Herein, specific kinds of the polyhydric carboxylic acid compound and the polyhydric alcohol component are the same as those described above, and thus, descriptions thereof will be omitted here.

The bireactive monomer is the same as a monomer used in the hybrid amorphous vinyl resin that will be described later, and thus a description thereof will be omitted here. Additionally, a method for manufacturing the hybrid crystalline polyester resin is also the same as the method for manufacturing the hybrid amorphous vinyl resin that will be described later, and thus a description thereof will be omitted here.

The hybrid crystalline polyester resin has a vinyl polymerization segment content of preferably from 1 to 30% by mass, and more preferably from 5 to 20% by mass.

In the core portion of the toner of the invention, a mass ratio of the amorphous polyester resin to the crystalline polyester resin (amorphous polyester resin/crystalline polyester resin) is preferably from 50/50 to 99/1, and more preferably from 60/40 to 96/4, still more preferably from 65/35 to 90/10 and particularly preferably from 67.5/32.5 to 87.5/12.5. When the mass ratio is in the range, low temperature fixability is improved.

<Hybrid Amorphous Vinyl Resin>

The hybrid amorphous vinyl resin contained in the shell portion of the toner of the invention is an amorphous vinyl resin in which a vinyl polymerization segment is chemically bonded to a polymerization segment other than the vinyl polymerization segment.

Vinyl Polymerization Segment

The vinyl polymerization segment constituting the hybrid amorphous vinyl resin is formed of an amorphous vinyl resin obtained by polymerizing a vinyl monomer. Specific examples of the hybrid amorphous vinyl resin include acrylic resins and styrene-acryl copolymer resins.

The vinyl monomer forming the vinyl polymerization segment to be used can be one kind or two or more kinds selected from those mentioned below:

(1) Styrene Monomers styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, derivatives thereof, and the like.

(2) (Meth)Acrylic Acid Ester Monomers

Methyl(meth)acrylate, ethyl(meth)acrylate, n-butyl(meth) acrylate, isopropyl(meth)acrylate, isobutyl(meth)acrylate, t-butyl(meth)acrylate, n-octyl(meth)acrylate, 2-ethylhexyl (meth)acrylate, stearyl(meth)acrylate, lauryl(meth)acrylate, phenyl(meth)acrylate, diethyl aminoethyl(meth)acrylate, dimethylaminoethyl(meth)acrylate, derivatives thereof, and the like.

(3) Vinyl Esters

Vinyl propionate, vinyl acetate, vinyl benzoate, and the like.

(4) Vinyl Ethers

Vinyl methyl ether, vinyl ethyl ether, and the like.

(5) Vinyl Ketones

Vinyl methyl ketone, vinyl ethyl ketone, vinyl hexyl ketone, and the like.

(6) N-Vinyl Compounds

N-vinylcarbazole, N-vinylindole, N-vinyl pyrrolidone, and the like.

(7) Others

Vinyl compounds such as vinyl naphthalene and vinyl pyridine, acrylic acid or methacrylic acid derivatives such as acrylonitrile, methacrylonitrile, and acrylamide, and the like.

In addition, preferable examples of the vinyl monomers to be used include monomers containing ionic dissociable groups such as carboxylic groups, sulfonate groups, and phosphate groups. Specific examples are those below.

Examples of a carboxylic group containing monomer include acrylic acid, methacrylic acid, maleic acid, itaconic acid, cinnamic acid, fumaric acid, maleic monoalkyl ester, and itaconic monoalkyl ester. Additionally, examples of a sulfonate group containing monomer include styrenesulfonic acid, allylsulfosuccinic acid, and 2-acrylamide-2-methylpropanesulfonic acid. Furthermore, examples of a phosphate group containing monomer include acid phosphoxyethyl methacrylate.

Furthermore, as the vinyl monomer, a polyfunctional vinyl can be used to obtain a vinyl resin having a crosslinking structure. Examples of the polyfunctional vinyl include divinyl benzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

The method for forming the vinyl polymerization segment is not particularly limited, and examples of the method include methods of performing polymerization by well-known polymerization techniques such as bulk polymerization, solution polymerization, emulsion polymerization, mini-emulsion polymerization, and dispersion polymerization using optional polymerization initiators such as peroxides, persulfides, persulfates, and azo compounds commonly used for polymerization of the monomers.

Examples of the polymerization segment other than the vinyl polymerization segment include a polyester polymerization segment, a urethane polymerization segment, and a urea polymerization segment. Among them, preferred is a polyester polymerization segment, from the viewpoint of adhesion to the core portion.

The vinyl polymerization segment content in the hybrid amorphous vinyl resin is from 51 to 99% by mass. When the content is less than 51% by mass, a polymerization segment other than the vinyl polymerization segment in the hybrid amorphous vinyl resin is easily exposed onto surfaces of the toner particles, and the crystalline polyester resin of the core portion having high affinity to the polymerization segment other than the vinyl polymerization segment is also easily exposed onto the toner surface, as a result of which image quality stability is reduced. Additionally, when the content exceeds 99% by mass, the amount of the contained polymerization segment other than the vinyl polymerization segment is too small, which makes fusion of the hybrid amorphous vinyl resin to the core portion insufficient. As a result of that, the core portion is easily exposed onto the toner surface, thus reducing image quality stability. The vinyl polymerization segment content in the hybrid amorphous vinyl resin is preferably from 51 to 95% by mass, more preferably from 65 to 90% by mass, and still more preferably from 70 to 85% by mass.

In addition, the vinyl polymerization segment content specifically refers to the percentage of a vinyl monomer mass to a total mass of resin materials used to synthesize the hybrid amorphous vinyl resin, i.e., a total monomer mass calculated by summing masses of a monomer(s) constituting the vinyl polymerization segment, a monomer(s) constituting the polymerization segment other than the vinyl polymerization segment, and a bireactive monomer, and the like used if necessary. Constituent components of the vinyl polymerization segment and the vinyl polymerization segment content can be identified, for example, by NMR measurement, methylation reaction P-GC/MS measurement, or the like.

The hybrid amorphous vinyl resin has a glass transition point of preferably from 25 to 70° C., and more preferably from 35 to 65° C. When the glass transition point of the hybrid amorphous vinyl resin is in the above range, sufficient low temperature fixability and heat-resistant storage property can be both obtained. Additionally, the glass transition point of the hybrid amorphous vinyl resin can be measured by the same measurement method as that for the glass transition point of the amorphous polyester resin.

In addition, a molecular weight of the hybrid amorphous vinyl resin measured by gel permeation chromatography (GPC) is preferably from 5,000 to 100,000 in terms of weight average molecular weight (Mw). The same method as that for the crystalline polyester resin is employed as the measurement method.

The binder resin has a hybrid amorphous vinyl resin content of preferably from 3 to 35% by mass, and more preferably from 5 to 30% by mass. When the content is in the range, adhesion between the core portion and the shell portion is promoted, whereby both image quality stability and low temperature fixability can be ensured.

The structure of the hybrid amorphous vinyl resin is not particularly limited, and examples of the structure include a block copolymer structure and a graft copolymer structure.

A preferable hybrid amorphous vinyl resin contained in the shell portion of the toner of the invention is a resin that includes a vinyl polymerization segment as a main chain and a polymerization segment other than the vinyl polymerization segment as a side chain. Among them, a resin that includes a vinyl polymerization segment as a main chain and a polyester polymerization segment as a side chain is particularly preferable.

With the use of such a hybrid amorphous vinyl resin, the polymerization segment other than the vinyl polymerization segment, such as the polyester polymerization segment included in the hybrid amorphous vinyl resin of the shell portion, is co-melted with the polyester resin of the core portion, thereby forming a shell portion that can be firmly fused with the surface of the core portion. Furthermore, the presence of the vinyl polymerization segment structurally different from the polyester resin on the toner surface side can inhibit the crystalline polyester resin of the core portion that tends to hinder charging from being exposed onto the toner surface. Thereby, toner chargeability is further improved, so that even during high-speed continuous printing, image quality stability can be more easily ensured.

The polymerization segment other than the vinyl polymerization segment is preferably a polyester polymerization segment, from the viewpoint of adhesion to the core portion. Hereinafter, a description will be given of a hybrid amorphous vinyl resin including a polyester polymerization segment as the polymerization segment other than the vinyl polymerization segment.

The vinyl polymerization segment and the polyester polymerization segment are preferably bonded to each other via a bireactive monomer. In addition, the polyester polymerization segment may be formed of a crystalline polyester resin or an amorphous polyester resin, but is preferably formed of an amorphous polyester resin, in terms of ensuring image quality stability even during high-speed continuous printing.

The vinyl monomers used for the vinyl polymerization segment and the method for forming the vinyl polymerization segment are the same as those described above, and thus descriptions thereof will be omitted here.

Polyester Polymerization Segment

The polyester polymerization segment constituting the hybrid amorphous vinyl resin is preferably formed of a polyester resin manufactured by performing a polycondensation reaction between a polyhydric carboxylic acid and a polyhydric alcohol in the presence of a catalyst. Herein, since the specific kinds of the polyhydric carboxylic acid and the polyhydric alcohol have been described in the sections of the crystalline polyester resin and the amorphous polyester resin, descriptions thereof will be omitted here.

Bireactive Monomer

The "bireactive monomer" is a monomer that bonds the vinyl polymerization segment to the polyester polymerization segment. It is a monomer that has, in a molecule thereof, both of a group selected from a hydroxyl group, a carboxyl group, an epoxy group, a primary amino group, and a secondary amino group forming the polyester polymerization segment and an ethylenically unsaturated group forming the vinyl polymerization segment. The bireactive monomer is preferably a monomer that contains a hydroxyl group or a carboxyl group and an ethylenically unsaturated group, and more preferably a monomer that contains a carboxyl group and an ethylenically unsaturated group.

Specific examples of the bireactive monomer include acrylic acid, methacrylic acid, fumaric acid, and maleic acid, and may further include esters of hydroxyalkyl (1 to 3 carbon atoms) thereof. From the viewpoint of reactivity, acrylic acid, methacrylic acid, or fumaric acid is preferable. The vinyl polymerization segment is boned to the polyester polymerization segment via the bireactive monomer.

A usage amount of the bireactive monomer is preferably from 1 to 20% by mass, and more preferably from 4 to 15% by mass, with respect to 100% by mass of a total amount of vinyl monomers constituting the vinyl polymerization segment, in terms of improving low temperature fixability of the toner.

Method for Manufacturing Hybrid Amorphous Vinyl Resin

A well-known manufacturing method can be applied as a method for manufacturing the hybrid amorphous vinyl resin. The following two manufacturing methods are typical ones:

(1) A method in which a vinyl polymerization segment is previously polymerized, and then, a bireactive monomer is reacted with the vinyl polymerization segment or the bireactive monomer is reacted simultaneously with other monomer(s) in polymerizing the vinyl polymerization segment, and additionally, reacted with a polyhydric carboxylic acid and a polyhydric alcohol for forming a polyester polymerization segment, thereby forming a polyester polymerization segment.

(2) A method in which a polyester polymerization segment and a vinyl polymerization segment are independently previously polymerized, and then are reacted with a bireactive monomer to bond both segments to each other.

The present invention can use any of the above manufacturing methods, but the method (1) is preferable. Specifically, preferably, the polyhydric carboxylic acid and the polyhydric alcohol forming the polyester polymerization segment and the vinyl monomer(s) forming the vinyl polymerization segment and the bireactive monomer are mixed together, and then, a polymerization initiator is added to perform an addition polymerization between the vinyl monomer(s) and the bireactive monomer and form a vinyl polymerization segment, followed by addition of an esterification catalyst to perform a polycondensation reaction.

Herein, the esterification catalyst used for synthesizing the polyester polymerization segment can be any of the various well-known catalysts mentioned in the section of the crystalline polyester resin. Examples of an esterification promoter include gallic acid.

The core-shell structure of the toner of the invention is not limited to the structure in which the shell portion completely covers the core portion, and, for example, may be a structure in which the shell portion does not completely cover the core portion and some parts of the core portion are exposed.

The core-shell structure can be confirmed by observing the cross-sectional structure of the toner, for example, using a well-known means such as a transmission electron microscope (TEM) or a scanning probe microscope (SPM).

[Other Components]

The toner of the invention may include, in addition to the above components, internal additives such as a release agent, a colorant, and a charging control agent and external additives such as inorganic microparticles, organic microparticles, and a lubricant.

<Release Agent (Wax)>

The release agent included in the toner is not particularly limited, and a well-known release agent can be used. Suitable waxes are, particularly, polyolefin-based waxes such as low molecular weight propylene and polyethylene or oxidized polypropylene and polyethylene and ester-based waxes such as behenyl behenate.

Specific examples of the waxes include polyolefin waxes such as polyethylene wax and polypropylene wax; branched chain hydrocarbon-based waxes such as microcrystalline wax; long chain hydrocarbon-based waxes such as paraffin wax and Sasol wax; dialkyl ketone-based waxes such as distearyl ketone; ester-based waxes such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, and distearyl maleate; and amide-based waxes such as ethylenediamine behenylamide and tristearylamide trimellitate.

Among them, preferred are those having low melting points, and specifically, those having a melting point of from 40 to 90° C., from the viewpoint of releasability in low temperature fixation. The percentage of a release agent content in the toner matrix particles is preferably from 1 to 20% by mass, and more preferably from 5 to 20% by mass.

<Colorant>

Examples of a colorant included in the toner include carbon blacks, magnetic materials, dyes, and pigments, and these can be optionally used. Examples of the carbon blacks include channel black, furnace black, acetylene black, thermal black, and lamp black. Examples of the magnetic materials include ferromagnetic metals such as iron, nickel, and cobalt, alloys including these metals, ferromagnetic metal compounds such as ferrite and magnetite, alloys that contain no ferromagnetic metals but exhibit ferromagnetism when heated, e.g., alloys of kinds referred to as Heusler alloys, such as manganese-copper-aluminum and manganese-copper-tin, and chromium dioxide.

Examples of a black colorant include carbon blacks such as furnace black, channel black, acetylene black, thermal black, and lamp black and magnetic powders such as magnetite and ferrite.

Examples of colorants for magenta or red include C.I. Pigment Reds 2, 3, 5, 6, 7, 15, 16, 48:1, 48:2, 48:3, 53:1, 57:1, 60, 63, 64, 68, 81, 81:1, 81:2, 81:4, 81:5, 83, 87, 88, 89, 90, 112, 114, 122, 123, 139, 144, 149, 150, 163, 166 170, 177, 178, 184, 202, 206, 207, 209, 222, 238, and 269.

In addition, examples of colorants for orange or yellow include C.I. Pigment Oranges 31 and 43, C.I. Pigment Yellows 12, 14, 15, 17, 74, 83, 93, 94, 138, 155, 162, 180, and 185.

Furthermore, examples of colorants for green or cyan include C.I. Pigment Blues 2, 3, 15, 15:2, 15:3, 15:4, 16, 17 60, 62, 66, and C.I. Pigment Green 7.

These colorants can be used singly or in combination of two or more selected therefrom, if necessary.

An amount of addition of a colorant is in a range of preferably from 1 to 30% by mass, and more preferably from 2 to 20% by mass with respect to the entire toner, and a mixture of the colorants can also be used in the range. When the amount of the colorant is in the range, image reproducibility can be ensured.

In addition, the size of the colorant is preferably from 10 to 1000 nm, more preferably from 50 to 500 nm, and still more preferably from 80 to 300 nm in terms of volume-based median diameter.

<Charging Control Agent>

Examples of the charging control agent include various kinds of well-known compounds such as nigrosine-based dyes, metal salts of naphthenic acids or higher fatty acids, alkoxylated amines, quaternary ammonium salt compounds, azo-based metal complexes, and metal salicylates.

The amount of a charging control agent to be added is usually from 0.1 to 10% by mass, and preferably from 0.5 to 5% by mass, with respect to 100% by mass of the binder resin in finally obtained toner particles.

The size of charging control agent particles is preferably from 10 to 1000 nm, more preferably from 50 to 500 nm, and still more preferably from 80 to 300 nm, in terms of number average primary particle diameter.

<External Additives>

The toner according to the invention may include external additive particles. External additive particles to be used can be well-known external additive particles. Examples of such external additive particles include inorganic oxide microparticles such as silica microparticles, alumina microparticles, or titania microparticles, or the like, inorganic stearic acid compound microparticles such as aluminum stearate microparticles or zinc stearate microparticles, and inorganic titanic acid compound microparticles such as strontium titanate and zinc titanate. These can be used singly or in combination of two or more kinds thereof. These inorganic microparticles are preferably those subjected to a gloss treatment by a silane coupling agent, a titanium coupling agent, a higher fatty acid, a silicone oil, or the like in order to improve heat-resistant storage property and environmental stability.

In addition, organic microparticles can also be used as external additive particles. As for organic microparticles, spherical organic microparticles having a primary particle size of about from 10 to 2000 nm can be used. Specifically, organic microparticles made of a homopolymer such as styrene or methyl methacrylate or made of a copolymer thereof can be used.

A lubricant can also be used as an external additive. The lubricant is used to further improve cleanability and transferability. Specific examples thereof include metal salts of higher fatty acids, such as zinc stearate, aluminum stearate, copper stearate, magnesium stearate, calcium stearate, and the like, zinc oleate, manganese oleate, iron oleate, copper oleate, magnesium oleate, and the like, zinc palmitate, copper palmitate, magnesium palmitate, calcium palmitate, and the like, zinc linoleate, calcium linoleate, and the like, zinc ricinoleate, calcium ricinoleate, and the like.

These external additives may be used in combination of various kinds thereof.

The amount of an external additive to be added is preferably from 0.1 to 10.0 parts by mass with respect to 100 parts by mass of the toner matrix particles. Examples of a method for adding an external additive include adding methods using various kinds of well-known mixers such as a Turbula mixer, a Henschel mixer, a Nauta mixer, and a V-shaped mixer.

<Glass Transition Point of Toner>

The glass transition point of the toner of the invention is preferably from 25 to 65° C., and more preferably from 35 to 60° C. When the glass transition point of the toner of the invention is in the above range, there can be obtained a toner having sufficient low temperature fixability and heat-resistant storage property. In addition, the glass transition point of the toner is measured in the same manner as the measurement method described in the section of the amorphous polyester resin, except for using the toner as a measurement sample.

<Toner Particle Size>

The toner particles according to the invention has a mean particle size of preferably from 3 to 8 μm, and more preferably from 5 to 8 μm, in terms of volume-based median diameter. The mean particle size can be controlled by the concentration of an aggregation agent, the amount of addition of an organic solvent, the time of fusion, the composition of the binder resin, and the like used in manufacturing the toner. When the volume-based median diameter is in the above range, very small dot images of 1200 dpi level can be reproduced with fidelity.

The volume-based median diameter of the toner particles is measured and calculated using a measurement apparatus that is a computer system incorporating a data processing software "Software V3.51" connected to "MULTISIZER 3" (manufactured by Beckman-Coulter Co. Ltd). Specifically, 0.02 g of the toner is added to 20 mL of a surfactant solution (e.g., a surfactant solution prepared by diluting a neutral detergent including a surfactant component with pure water by 10 times for dispersion of toner particles) and mixed thoroughly, followed by ultrasonic dispersion for 1 minute to prepare a toner dispersion solution. The toner dispersion solution is injected into a beaker containing "ISOTON II" (manufactured by Beckman-Coulter Co., Ltd.) in a sample stand using a pipette until a concentration indicated by the measurement apparatus becomes 8%. Herein, by setting the concentration to the range, a measurement value that exhibits reproducibility can be obtained. Then, in the measurement apparatus, a measured particle count number of 25000 and an aperture diameter of 50 μm are set, and the range of from 1 to 30 μm that is a measurement range is divided into 256 ranges to calculate frequency values. Then, a particle diameter at 50% from the larger side of the volume accumulation ratio is designated as a volume-based median diameter.

<Mean Circularity of Toner>

In the toner according to the invention, the individual toner particles constituting the toner have a mean circularity of preferably from 0.920 to 1,000, and more preferably from 0.920 to 0.995, from the viewpoint of stability of charging characteristics and low temperature fixability. When the mean circularity is in the above range, the individual toner particles are hardly pulverized, which suppresses contamination of a frictional charging member, thereby stabilizing toner chargeability and improving quality of a formed image. The mean circularity of the toner is a value measured using "FPIA-2100" (manufactured by Sysmex Corporation). Specifically, a measurement sample (toner) is mixed thoroughly in a surfactant-containing aqueous solution, and dispersed by performing an ultrasonic dispersion treatment for 1 minute. Then, photographing is performed at an appropriate concentration of an HPF detection number of from 3,000 to 10,000 in a measurement condition of an HPF (high magnification imaging) mode by "FPIA-2100" (manufactured by Sysmex Corporation). Circularities of the individual toner particles are calculated according to the following formula. Then, the circularities of the respective toner particles are added, and divided by the total number of the toner particles to obtain the mean circularity of the toner. When the HPF detection number is in the above range, reproducibility can be obtained.

Circularity=(circumferential length of circle having the same projection area as particle image)/(circumferential length of particle projection image)

[Method for Manufacturing Toner of the Invention]

The method for manufacturing the toner of the invention is not particularly limited, and examples of the method include well-known methods such as kneading and pulverization methods, suspension polymerization methods, emulsion aggregation methods, dissolution suspension methods, polyester elongation methods, and dispersion polymerization methods.

Among them, emulsion aggregation methods are preferably employed, from the viewpoint of particle size uniformity, shape controllability, and facilitation of formation of a core-shell structure. Hereinafter, an emulsion aggregation method will be described.

(Emulsion Aggregation Method)

The emulsion aggregation method is performed as follows: a dispersion solution of resin microparticles (hereinafter referred to also as "resin particles") dispersed by a surfactant and a dispersion stabilizer is mixed with a dispersion solution of toner particle constituting components such as colorant microparticles, and an aggregation agent is added to aggregate the particles until a desired toner particle size is obtained; after that or simultaneously with the aggregation, fusion between the resin particles and shape control are performed, thereby forming toner particles.

The resin particles can be manufactured, for example, by an emulsion polymerization method, a mini-emulsion polymerization method, a phase inversion emulsion method, or the like or in combination of some manufacturing methods. In a case of adding an internal additive in the resin particles, a mini-emulsion polymerization method is particularly preferably used.

In a case of adding an internal additive in the toner particles, the resin particles may be those containing the internal additive. Alternatively, a dispersion solution of internal additive particles containing only the internal additive may be separately prepared, and then, the internal additive particles may be co-aggregated when the resin particles are aggregated.

A core-shell type toner as in the invention is obtained by an emulsion aggregation method as follows: first, binder resin particles for core particles are aggregated and fused with a colorant(s) if necessary to produce core particles; next, binder resin particles for the shell portion are added in a dispersion solution of the core particles, and aggregated and fused onto surfaces of the core particles to form a shell portion covering the surfaces of the core particles, thereby obtaining a core-shell type toner.

In manufacturing the toner by an emulsion aggregation method, a toner manufacturing method according to a preferable embodiment includes the steps of: (a) preparing a crystalline polyester resin particle dispersion solution, an amorphous polyester resin particle dispersion solution, and a hybrid amorphous vinyl resin particle dispersion solution (hereinafter also referred to as preparation step); (b) mixing the crystalline polyester resin particle dispersion solution with the amorphous polyester resin particle dispersion solution and performing aggregation and fusion (hereinafter also referred to as core particle aggregation-fusion step); and (c) adding the hybrid amorphous vinyl resin particle dispersion solution to the dispersion solution containing the core particles and aggregating and fusing a hybrid amorphous vinyl resin onto surfaces of the core particles to form a shell portion (hereinafter also referred to as shell portion forming step).

Hereinafter, a detailed description will be given of the respective steps (a) to (c) and respective steps (d) to (f) that are optionally performed in addition to the steps.

(a) Preparation Step

The step (a) includes a step of preparing a crystalline polyester resin particle dispersion solution, a step of preparing an amorphous polyester resin particle dispersion solution, and a step of preparing a hybrid amorphous vinyl resin particle dispersion solution, and, if necessary, includes a step of preparing a colorant particle dispersion solution, a step of preparing a release agent particle dispersion solution, and the like.

(a-1) Step of Preparing Crystalline Polyester Resin Particle Dispersion Solution The step of preparing a crystalline polyester resin particle dispersion solution is a step of synthesizing a crystalline polyester resin constituting toner particles and dispersing the crystalline polyester resin in a form of microparticles in an aqueous medium to prepare a dispersion solution of crystalline polyester resin particles.

The method for manufacturing the crystalline polyester resin is the same as described above, and thus a description thereof will be omitted here.

Examples of a preparation method of the crystalline polyester resin particle dispersion solution include a method of performing a dispersion treatment in an aqueous medium without using any solvent and a method of preparing a solution by dissolving the crystalline polyester resin in a solvent such as ethyl acetate, emulsifying and dispersing the solution in an aqueous medium using a disperser, and then performing a desolvation treatment.

In the present invention, the "aqueous medium" refers to one that includes at least 50% by mass or more of water, and a component other than the water may be an organic solvent that is dissolved in water. Examples of the organic solvent include methanol, ethanol, isopropanol, butanol, acetone, methyl ethyl ketone, dimethyl formamide, methyl cellosolve, and tetrahydrofuran. Among them, preferred are alcohol-based organic solvents such as methanol, ethanol, isopropanol, and butanol, which are organic solvents that do not dissolve resins. Preferably, only water is used as the aqueous medium.

The crystalline polyester resin can include a carboxyl group in a structural unit thereof. In such a case, the carboxyl group included in the unit may be ionically dissociated and stably emulsified in a water phase. In order to smoothly advance emulsification, ammonium, sodium hydroxide, or the like may be added.

Furthermore, a dispersion stabilizer may be dissolved in the aqueous medium, and a surfactant, resin particles, and the like may be added for improving dispersion stability of oil droplets.

A well-known dispersion stabilizer can be used, and, for example, an acid- or alkali-soluble dispersion stabilizer such as tricalcium phosphate is preferably used. Alternatively, from the viewpoint of environmental aspects, it is preferable to use a dispersion stabilizer that can be decomposed by an enzyme.

As the surfactant, well-known anionic surfactants, cationic surfactants, non-ionic surfactants, and amphoteric surfactants can be used.

In addition, examples of the resin particles for improving dispersion stability include polymethyl methacrylate resin particles, polystyrene resin particles, and polystyrene-acrylonitrile resin particles.

Such a dispersion treatment as described above can be performed using a mechanical energy, and the disperser is not particularly limited. Examples of the disperser include a homogenizer, a low-speed shearing type disperser, a high-speed shearing type disperser, a friction type disperser, a high-pressure jet type disperser, an ultrasonic disperser, a high-pressure impact type disperser ULTIMAIZER, and an emulsion disperser.

In performing dispersion, the solution is preferably heated. The heating condition is not particularly limited, but is usually about from 60 to 100° C.

In the crystalline polyester resin particle dispersion solution thus prepared, the crystalline polyester resin particles (oil droplets) have a particle size of preferably from 60 to 1000 nm, and more preferably from 80 to 500 nm in terms of volume-based median diameter. The volume-based median diameter can be measured by a dynamic light scattering method using "MICRO TRACK UPA-150" (manufactured by Nikkiso Co., Ltd). In addition, the dispersion diameter of the oil droplets can be controlled by the magnitude of a mechanical energy or the like in emulsion dispersion, and can be measured by a method described in Examples. The volume-based median diameter of the oil droplets can be controlled by the degree of neutralization and the magnitude of to mechanical energy in emulsion dispersion.

Additionally, the crystalline polyester resin particle dispersion solution has a crystalline polyester resin particle content ranging preferably from 10 to 50% by mass, and more preferably from 15 to 40% by mass, with respect to 100% by mass of the entire dispersion solution. When the content is in the range, expansion of particle size distribution can be suppressed, so that toner characteristics can be improved.

(a-2) Step of Preparing Amorphous Polyester Resin Particle Dispersion Solution

The step of preparing an amorphous polyester resin particle dispersion solution is a step of synthesizing an amorphous resin constituting toner particles and dispersing the amorphous polyester resin in a form of microparticles into an aqueous medium to prepare a dispersion solution of amorphous polyester resin particles.

The method for manufacturing the amorphous polyester resin is the same as described above, and thus a description thereof will be omitted here. Additionally, the method for preparing the dispersion solution is the same as the contents described in the (a-1) step of preparing a crystalline polyester resin particle dispersion solution, and thus a description thereof will be omitted here.

In the amorphous polyester resin particle dispersion solution, for example, the amorphous polyester resin particles have a particle size ranging preferably from 30 to 500 nm in terms of volume-based median diameter. The particle size of the amorphous polyester resin particles can be measured by a dynamic light scattering method, for example, using "MICRO TRACK UPA-150" (manufactured by Nikkiso Co., Ltd). In addition, the dispersion diameter of the oil droplets can be controlled by the magnitude of mechanical energy or the like in emulsion dispersion.

(a-3) Step of Preparing Hybrid Amorphous Vinyl Resin Particle Dispersion Solution The step of preparing a hybrid amorphous vinyl resin particle dispersion solution is a step of synthesizing a hybrid amorphous vinyl resin constituting toner particles and dispersing the hybrid amorphous vinyl resin in a form of microparticles into an aqueous medium to prepare a dispersion solution of hybrid amorphous vinyl resin particles.

The method for manufacturing the hybrid amorphous vinyl resin is the same as described above, and thus a description thereof will be omitted here. In addition, the method for preparing the hybrid amorphous vinyl resin particle dispersion solution is the same as the contents described in the (a-1) step of preparing a crystalline polyester resin particle dispersion solution, and thus a description thereof will be omitted here.

In the hybrid amorphous vinyl resin particle dispersion solution, for example, the hybrid amorphous vinyl resin particles have a particle size ranging preferably from 30 to 500 nm in terms of volume-based median diameter. The particle size of the hybrid amorphous vinyl resin particles can be measured by a dynamic light scattering method, for example, using "MICRO TRACK UPA-150" (manufactured by Nikkiso Co., Ltd). In addition, the dispersion diameter of the oil droplets can be controlled by the magnitude of a mechanical energy or the like in emulsion dispersion.

(a-4) Step of Preparing Colorant Particle Dispersion Solution/Step of Preparing Release Agent Particle Dispersion Solution The step of preparing a colorant particle dispersion solution is a step of dispersing a colorant in a form of microparticles into an aqueous medium to prepare a dispersion solution of colorant particles. Additionally, the step of preparing a release agent particle dispersion solution is a step that is performed if necessary when the toner particles are desired to include a release agent, and that is a step of dispersing the release agent in a form of microparticles into an aqueous medium to prepare a dispersion solution of release agent particles.

The aqueous medium is the same as described in the (a-1), and a surfactant and resin particles may be added into the aqueous medium for improving dispersion stability.

The dispersion of a colorant/a release agent can be performed using a mechanical energy. Such a disperser is not particularly limited, and any of those described in the (a-1) can be used.

The colorant particle dispersion solution has a colorant content ranging preferably from 10 to 50% by mass, and more preferably from 15 to 40% by mass. When the colorant content is in the range, there is an advantageous effect of ensuring color reproducibility. In addition, the release agent particle dispersion solution has a release agent particle content ranging preferably from 10 to 50% by mass, and more preferably from 15 to 40% by mass. When the release agent particle content is in the range, there can be obtained advantageous effects of preventing hot offset and ensuring releasability.

In the colorant particle dispersion solution, the colorant particles have a dispersion diameter ranging preferably from 10 to 300 nm in terms of volume-based median diameter. The dispersion diameter of the colorant particles in the colorant particle dispersion solution can be measured by a dynamic light scattering method, for example, using "MICRO TRACK UPA-150" (manufactured by Nikkiso Co., Ltd).

In the release agent particle dispersion solution, the colorant particles have a dispersion diameter ranging preferably from 10 to 300 nm in terms of volume-based median diameter. The dispersion diameter of the release agent particles in the release agent particle dispersion solution can be measured by a dynamic light scattering method, for example, using "MICRO TRACK UPA-150" (manufactured by Nikkiso Co., Ltd).

(b) Core Particle Aggregation and Fusion Step

The core particle aggregation and fusion step is a step of aggregating the above-described crystalline polyester resin particles, amorphous polyester resin particles, and, if necessary, colorant particles and/or release agent particles together and simultaneously fusing the particles together in an aqueous medium.

In this step, first, the crystalline polyester resin particles, the amorphous polyester resin particles, and, if necessary, the colorant particles and/or the release agent particles are mixed together, and these particles are dispersed in an aqueous medium. Next, an alkali metal salt, a salt containing a Group II element, or the like is added as a aggregation agent. Then, the mixture solution is heated at a temperature equal to or higher than the glass transition points of the crystalline polyester resin particles and the amorphous polyester resin particles to advance aggregation and simultaneously fuse the resin particles together.

Specifically, the dispersion solution of the crystalline polyester resin particles, the dispersion solution of the amorphous polyester resin particles, and, if necessary, the colorant particle dispersion solution and/or the release agent particle dispersion solution, prepared according to the above-described steps, are mixed together, and a aggregation agent such as magnesium chloride is added, whereby the crystalline polyester resin particles, the amorphous polyester resin particles, and if necessary, the colorant particles and/or the release agent particles are aggregated together, and simultaneously, the particles are fused to each other, as a result of which the core portion of the toner is formed.

The aggregation agent used in the present step is not particularly limited, and any selected from metal salts is suitably used. Examples thereof include salts of monovalent metals such as alkali metals including sodium, potassium, and lithium, salts of divalent metals such as calcium, magnesium, manganese, and copper, and salts of trivalent metals such as iron and aluminum. Specific examples of the salts include sodium chloride, potassium chloride, lithium chloride, calcium chloride, magnesium chloride, zinc chloride, copper sulfate, magnesium sulfate, and manganese sulfate. Among them, particularly preferred are the salts of divalent metals. Use of a salt of a divalent metal allows aggregation to be advanced with a smaller amount of the salt. These aggregation agents can be used singly or in combination of two or more kinds thereof.

In the aggregation step, a standing time for allowing the mixture solution to stand (a time taken until heating is started) after adding the aggregation agent is preferably made as short as possible. Specifically, after adding the aggregation agent, heating of the dispersion solution for aggregation is preferably started as immediately as possible so as to have a temperature equal to or higher than the glass transition points of the crystalline polyester resin and the amorphous polyester resin. Although the reason for this is unclear, problems can occur, such as destabilization of a particle size distribution of obtained toner particles or fluctuation of surface properties thereof caused by the state of particle aggregation that fluctuate with the passage of the standing time. The standing time is usually 30 minutes or less, and preferably, 10 minutes or less. The temperature for adding the aggregation agent is not particularly limited, but is preferably equal to or lower than the glass transition points of the crystalline polyester resin and the amorphous polyester resin included in the core portion.

Additionally, in the aggregation step, preferably, the temperature increase is immediately performed by heating after adding the aggregation agent, and is preferably performed at a rate of 0.8° C./min or higher. An upper limit of the temperature increase rate is not particularly limited, but preferably 15° C./min or lower, from the viewpoint of preventing the occurrence of coarse particles due to rapid advancement of fusion. Furthermore, after the temperature of the dispersion solution for aggregation reaches a desired temperature, fusion needs to be continued while maintaining the temperature of the dispersion solution for aggregation for a certain length of time, preferably, until a volume-based median diameter of from 4.5 to 7.0 μm is obtained (a first aging step).

(c) Shell Portion Formation Step

In order to obtain the toner having the core-shell structure of the invention, after the first aging step, the dispersion solution of the hybrid amorphous vinyl resin particles forming the shell portion is furthermore added, and the hybrid amorphous vinyl resin forming the shell portion is aggregated and fused onto surfaces of particles (core particles) of the binder resin obtained above. Thereby, there can be obtained toner particles having a core-shell structure. Then, when the size of the aggregated particles becomes an intended size, a salt such as an aqueous sodium chloride solution or the like is added to stop the aggregation. After that, preferably, in order to further strengthen aggregation and fusion of the shell portion onto the core particle surface and for the particles to have a desired shape, heating treatment of the reaction system is performed until the particles have a desired shape (a second aging step). The second aging step may be performed until the mean circularity of the toner particles having the core-shell structure comes in the range of the mean circularity mentioned above.

Thereby, the growth of the particles (the aggregation of the crystalline polyester resin particles, the amorphous polyester resin particles, the hybrid amorphous vinyl resin particles, and, if necessary, the colorant particles/release agent particles) and fusion (the disappearance of interfaces between the particles) can be effectively advanced, so that durability of toner particles finally obtained can be improved.

(d) Cooling Step

The cooling step is a step of performing a cooling treatment of the dispersion solution of the toner particles. A cooling rate in the cooling treatment is not particularly limited, but preferably is from 0.2 to 20° C./min. A cooling treatment method is not particularly limited, and examples thereof include a method of cooling by introducing a refrigerant from an outside of the reactor vessel and a method of cooling by directly feeding cold water into the reaction system.

(e) Filtration, Washing, and Drying Steps

In a filtration step, toner matrix particles are filtered out from the dispersion solution of the toner particles. Examples of a filtration treatment method include a centrifugal separation method, a filtration method under reduced pressure using a Nutsche, and a filtration method using a filter press, but the filtration treatment method is not particularly limited thereto.

Next, by washing in a washing step, adhered substances such as the surfactant and the aggregation agent are removed from the toner matrix particles (a cake-shaped aggregate) filtered out. In the washing treatment, water washing is performed until the filtrate has an electrical conductivity level, for example, of from 5 to 10 μS/cm.

In a drying step, a drying treatment is performed on the washed toner matrix particles. Examples of a dryer used in the drying step include well-known drying machines such as a spray dryer, a flash jet dryer, a vacuum freeze dryer, and a decompression dryer, and it is also possible to use a shelf-type static dryer, a shelf-type mobile dryer, a fluidized bed dryer, a rotary dryer, or a stirring-type dryer. The amount of moisture included in the dried toner matrix particles is preferably 5% by mass or less, and more preferably 2% by mass or less.

In addition, in a case in which the dried toner matrix particles are aggregated by a weak interparticle attraction force, a pulverization treatment may be performed. Examples of a pulverizer that can be used include mechanical pulverizers such as a jet mill, a Henschel mixer, a coffee mill, and a food processor.

(f) External Additive Treatment Step

This step is a step of adding an external additive to surfaces of the dried toner matrix particles if necessary and mixing together to produce a toner. Addition of an external additive improves fluidity and chargeability of the toner, and also achieves improvement in cleanability and the like.

[Developer for Developing Electrostatic Latent Image]

The toner of the invention can also be used as a magnetic or non-magnetic one-component developer, but may be used as a two-component developer by mixing with a carrier. In a case of using the toner as a two-component developer, examples of the carrier that can be used include magnetic particles made of conventionally well-known materials, such as metals such as iron, ferrite, and magnetite, and alloys of the metals and metals such as aluminum and lead. Particularly, ferrite particles are preferable. Additionally, examples of the carrier usable include a coated carrier obtained by coating surfaces of magnetic particles with a covering agent such as a resin and a dispersion type carrier obtained by dispersing a magnetic fine powder in a binder resin.

The carrier has a volume-based median diameter of preferably from 15 to 100 μm, and more preferably from 25 to 60 μm. The volume-based median diameter of the carrier can be measured typically by a laser diffraction particle size distribution measuring apparatus "HELOS" provided with a wet-type disperser (manufactured by Sympatec Co., Ltd).

[Image Forming Method]

The electrostatic latent image developing core-shell type toner and the electrostatic latent image developing developer according to the invention can be used in various well-known electrographic image forming methods. For example, the toner and the developer can be used for monochrome image forming methods and full-color image forming methods. Examples of the full-color image forming methods include a four-cycle type image forming method formed by four kinds of color developing devices associated with each of yellow, magenta, cyan, and black and a single electrostatic latent image support member (referred also as to "electrophotographic photoreceptor" or simply "photoreceptor") and a tandem type image forming method incorporating image forming units for each color that include a color developing device and an electrostatic latent image support member associated with each color, and any of the image forming methods can be used for the toner and the developer of the invention.

A preferable image forming method is an image forming method that includes a fixation step by a thermal compression fixation method that can apply pressure and can heat.

In the present image forming method, specifically, with the use of the toner according to the invention, for example, a toner image is obtained by developing an electrostatic latent image formed on a photoreceptor. The toner image is transferred onto an image support member. Then, the toner image transferred onto the image support member is fixated onto the image support member by a fixation treatment using the thermal compression fixation method, whereby an image printed matter with a visible image formed thereon can be obtained.

Pressure application and heating in the fixation step are preferably simultaneously performed, or, first, pressure may be applied, followed by heating.

As the fixation device using the thermal compression fixation method in an image forming method using the toner according to the invention, various well-known fixation devices can be employed. Hereinafter, a description will be given of, as thermal compression fixation devices, a heat roller type fixation device and a film heating type fixation device.

(i) Heat Roller Type Fixation Device

The heat roller type fixation device is typically provided with a pair of rollers including a heating roller and a pressurizing roller that comes in contact therewith. The pressurizing roller is deformed by pressure applied between the heating roller and the pressurizing roller, whereby a so-called fixation nip portion is formed at the deformed part.

The heating roller typically includes a heat source formed by a halogen lamp or the like arranged inside a core metal composed of a hollow metal roller made of aluminum or the like. The core metal is heated by the heat source, and electrical conduction to the heat source is controlled to adjust temperature so that an outer peripheral surface of the heating roller is maintained at a predetermined fixation temperature.

Particularly, in a case of using as a fixation device of an image forming apparatus forming a full-color image that is required to have an ability to mix colors by sufficiently heating and melting toner images consisting of four toner layers at maximum, it is preferable to use a heating roller that includes a core metal having high heat capacity and includes an elastic layer for homogeneously melting the toner images formed on an outer peripheral surface of the core metal.

In addition, the pressurizing roller includes an elastic layer made of a soft rubber such as, for example, urethane rubber or silicon rubber.

The pressurizing roller is assumed to include a core metal composed of a hollow metal roller made of, for example, aluminum or the like, in which an elastic layer may be formed on an outer peripheral surface of the core metal.

Furthermore, when configured to include the core metal, the pressurizing roller may be configured such that, as in the heating roller, a heat source made of a halogen lamp or the like is arranged inside the core metal to heat the core metal by the heat source, and electrical conduction to the heat source is controlled to adjust temperature so that an outer peripheral surface of the pressurizing roller is maintained at a predetermined fixation temperature.

As the heating roller and/or pressurizing roller, it is preferable to use a roller that includes, as an outermost layer, a releasing layer made of a fluorine resin such as, for example, polytetrafluoroethylene (PTFE) or a tetrafluoroethylene-perfluoroalkylvinylether copolymer (PFA), or the like. The releasing layer can have a thickness of roughly from 10 to 30 μm.

In such a heat roller type fixation device, heating by the heating roller and pressure application at the fixation nip portion are performed by sandwich-conveying the image support member on which a visible image is to be formed to the fixation nip portion by rotating the roller pair, whereby an unfixated toner image is fixated to the image support member.

(ii) Film Heating Type Fixation Device

The film heating type fixation device typically includes a heating member formed by, for example, a ceramic heater, a pressurizing roller, and a fixation film made of a heat-resistant film disposed between the heating member and the pressurizing roller. The pressurizing roller is deformed by pressure applied between the heating member and the pressurizing roller, whereby a so-called fixation nip portion is formed at the deformed portion.

Examples of the fixation film to be used include a heat-resistant film, sheet, or belt made of polyimide or the like. In addition, the fixation film may be configured to include the heat-resistant film, sheet, or belt made of polyimide as a film base and a releasing layer formed on the film base and made of a fluorine resin such as tetrafluoroethylene (PTFE) or tetrafluoroethylene-perfluoroalkylether copolymer (PFA), or the like. Furthermore, the fixation film may include an elastic layer made of rubber or the like disposed between the film base and the releasing layer.

In such a film heating type fixation device, an image support member carrying an unfixated toner image is sandwich-conveyed, together with the fixation film, between the fixation film and the pressurizing roller forming the fixation nip portion, thereby performing heating by the heating member via the fixation film and applying pressure at the fixation nip portion, as a result of which the unfixated toner image is fixated onto the image support member.

According to such a film heating type fixation device, only when forming an image, the heating member may be energized and electricity is conducted to the heating member to generate heat at a predetermined fixation temperature. Accordingly, there can be obtained quick startability that reduces a standby time between power-up of the image forming apparatus and a status in which image formation can be performed. Accordingly, since power consumption of the image forming apparatus during the standby time is very small, advantages such as achievement of power saving are obtainable.

As described above, the heating roller, the pressurizing roller, and the fixation film used as fixating members in the fixation step are preferably configured to include a plurality of layers. Furthermore, the elastic layers of the fixating members have a thickness of preferably from 50 to 300 μm. When the thicknesses of the elastic layers are in the range, the fixating members are closely contacted with toner particles and thereby heat conduction is facilitated, so that melting of the toner particles is promoted.

EXAMPLES

Hereinafter, typical embodiments of the present invention will be provided to further illustrate the invention. However, obviously, the invention is not limited thereto. Additionally, in the Examples, "part(s)" indicates "part(s) by mass", and "%" indicates "% by mass" unless otherwise specified.

In addition, weight average molecular weights of resins, melting points of crystalline polyester resins, softening points of amorphous polyester resins, and glass transition points of amorphous polyester resins and hybrid amorphous polyester resins were measured as follows.

<Weight Average Molecular Weight of Resin>

Using an apparatus: "HLC-8120GPC" (manufactured by Tosoh Corporation) and columns: "TSK guard column+ TSKgel Supper HZ-M (3 columns in series)" (manufactured by Tosoh Corporation), tetrahydrofuran (THF) as a carrier solvent was allowed to flow at a flow rate of 0.2 mL/min while maintaining a column temperature of 40° C., and a measurement sample was dissolved in the tetrahydrofuran so as to have a concentration of 1 mg/ml under dissolution conditions where the measurement sample was subjected to a 5-minute treatment using an ultrasonic disperser at room temperature. Next, the resulting solution was filtered through a membrane filter with a pore size of 0.2 μm to obtain a sample solution. 10 μL of the sample solution and the carrier solvent were injected together in the apparatus to perform detection using a refractive index detector (RI detector). Then, a molecular weight distribution of the measurement sample was calculated by a calibration curve measured using monodisperse polystyrene standard particles. Ten kinds of polystyrene standard particles were used for measuring the calibration curve.

<Melting Point of Crystalline Polyester Resin>

The melting point of a crystalline polyester resin was measured as follows. Specifically, using a differential scanning calorimeter "Diamond DSC" (manufactured by Perkin Elmer Co., Ltd.), measurement was performed under measurement conditions (temperature increase and cooling conditions) of going through a first temperature increase process of increasing temperature from 0° C. to 200° C. at a temperature increase rate of 10° C./min, a cooling process of cooling from 200° C. to 0° C. at a cooling rate of 10° C./min, and a second temperature increase process of increasing temperature from 0° C. to 200° C. at a temperature increase rate of 10° C./min in this order. On the basis of a DSC curve obtained by the measurement, an endothermic peak top temperature derived from the crystalline polyester resin in the first temperature increase process was designated as a melting point (Tc). In the measurement steps, 3.0 mg of the measurement sample was encapsulated in an aluminum pan, and the pan was placed on a diamond DSC sample holder. A vacant aluminum pan was used for a reference sample.

<Softening Point of Amorphous Polyester Resin>

The softening point of an amorphous polyester resin was measured as follows. In an environment with a temperature of 20° C.±1° C. and a relative humidity of 50±5% RH, 1.2 g of an amorphous polyester resin was placed in a petri dish and flattened. After allowing the resin to stand for 12 hours or longer, pressure was applied with a force of 3820 kg/cm$^2$ for 30 seconds by a molder SSP-10A (manufactured by Shimadzu Corporation) to produce a cylindrical molded sample having a diameter of 1 cm.

In an environment with 24° C.±5° C. and 50±20% RH, the molded sample was extruded by a flow tester CFT-500D (manufactured by Shimadzu Corporation) from a hole of a cylindrical die (1 mm in diameter×1 mm) under conditions: load 196 N (20 kgf), starting temperature 60° C., preheating time 300 seconds, and temperature increase rate 6° C./min, using a piston having a diameter of 1 cm from a time when preheating ended. An offset temperature $T_{offset}$ measured at an offset value of 5 mm by an offset method using a melting temperature measurement method (a temperature increasing method) was designated as a softening point of the amorphous polyester resin.

<Glass Transition Points of Amorphous Polyester Resin and Hybrid Amorphous Polyester Resin>

Measurement was performed using the "diamond DSC" (manufactured by Perkin Elmer Co., Ltd.). The measurement steps and the measurement conditions were the same as those in the above <Melting Point of Crystalline Polyester Resin>. Analysis was made on the basis of data of the second temperature increase process. An extension line of a baseline before rising of a first endothermic peak and a tangential line indicating a maximum inclination in a range from a rising portion of the first peak to a peak top were drawn, and an intersection point between the lines was designated as a glass transition point.

[Core Resin: Production of Crystalline Polyester Resin Dispersion Solution]

<Synthesis of Crystalline Polyester Resin (cm-1)>

The following raw material monomers of a polycondensation-based resin (crystalline polyester resin: cm-1) were placed in a four-necked flask equipped with a nitrogen introducing tube, a dewatering conduit, a stirrer, and a thermocouple, and heated to 170° C. to be dissolved:

Dodecane dioic acid: 99.9 parts by mass 1,9-nonane diol: 70.4 parts by mass

Next, 0.8 parts by mass of $Ti(O\text{-}n\text{-}Bu)_4$ (tetra-normal-butyl titanate) as an esterification catalyst was fed, and the temperature of the mixture was increased to 235° C. Then, the mixture was allowed to react under normal pressure (101.3 kPa) for 5 hours, and additionally, under reduced pressure (8 kPa) for 1 hour.

Next, the reaction mixture was cooled to 200° C. and then allowed to react under reduced pressure (20 kPa) for 1 hour to obtain a crystalline polyester resin (cm-1). The crystalline polyester resin (cm-1) had a weight average molecular weight (Mw) of 4,500 and a melting point (Tc) of 72° C.

<Synthesis of Crystalline Polyester Resin (cm-2)>

A crystalline polyester resin (cm-2) was produced in the same manner as in the above <Synthesis of Crystalline Polyester Resin (cm-1)> except that the kinds and amounts of the polyhydric alcohol and the polyhydric carboxylic acid were changed as below:

Tetradecane dioic acid: 99.9 parts by mass 1,9-nonane diol: 62.9 parts by mass

The crystalline polyester resin (cm-2) had a weight average molecular weight (Mw) of 5,500 and a melting point (Tc) of 75° C.

<Synthesis of Crystalline Polyester Resin (cm-3)>

A crystalline polyester resin (cm-3) was produced in the same manner as in the above <Synthesis of Crystalline Polyester Resin (cm-1)> except that the kinds and amounts of the polyhydric alcohol and the polyhydric carboxylic acid were changed as below:

Tetradecane dioic acid: 99.9 parts by mass 1,6-hexane diol: 46.6 parts by mass

The crystalline polyester resin (cm-3) had a weight average molecular weight (Mw) of 6,000 and a melting point (Tc) of 75° C.

<Synthesis of Crystalline Polyester Resin (cm-4)>

A crystalline polyester resin (cm-4) was produced in the same manner as in the above <Synthesis of Crystalline Polyester Resin (cm-1)> except that the kinds and amounts of the polyhydric alcohol and the polyhydric carboxylic acid were changed as below:

Sebacic acid: 99.9 parts by mass 1,9-nonane diol: 80.1 parts by mass

The crystalline polyester resin (cm-4) had a weight average molecular weight (Mw) of 5,800 and a melting point (Tc) of 68° C.

<Synthesis of Crystalline Polyester Resin (cm-5)>

The following raw material monomers of a polycondensation-based resin (crystalline polyester resin: cm-5) were placed in a four-necked flask equipped with a nitrogen introducing tube, a dewatering conduit, a stirrer, and a thermocouple, and heated to 170° C. to be dissolved:

Dodecane dioic acid: 89.9 parts by mass 1,9-nonane diol: 57.1 parts by mass

Next, a mixture solution obtained by stirring and mixing the following raw material monomers of a vinyl resin component was added dropwise in 1 hour through a liquid feeding pump. After aging the addition polymerization reaction for 1 hour while maintaining the resulting solution at 170° C., the raw material monomers of the vinyl resin component were removed at 8.3 kPa for 1 hour:

Styrene: 7.6 parts by mass n-Butyl acrylate: 7.0 parts by mass

Acrylic acid: 2.5 parts by mass

Polymerization initiator (di-t-butyl peroxide): 5.1 parts by mass

Next, 0.8 parts by mass of $Ti(O\text{-}n\text{-}Bu)_4$ (tetra-normal-butyl titanate) as an esterification catalyst was fed, and the temperature of the mixture was increased to 235° C. Then, the mixture was allowed to react under normal pressure (101.3 kPa) for 5 hours, and additionally, under reduced pressure (8 kPa) for 1 hour.

Next, the reaction mixture was cooled to 200° C. and then allowed to react under reduced pressure (20 kPa) for 1 hour to obtain a crystalline polyester resin (cm-5). The crystalline polyester resin (cm-5) had a weight average molecular weight (Mw) of 6,000 and a melting point (Tc) of 71° C.

<Synthesis of Crystalline Polyester Resin (cm-6)>

The following raw material monomers of a polycondensation-based resin (crystalline polyester resin: cm-6) were placed in a four-necked flask equipped with a nitrogen introducing tube, a dewatering conduit, a stirrer, and a thermocouple, and heated to 170° C. to be dissolved:

Dodecane dioic acid: 89.9 parts by mass 1,9-nonane diol: 57.1 parts by mass

Next, 0.8 parts by mass of $Ti(O\text{-}n\text{-}Bu)_4$ (tert-normal-butyl titanate) as an esterification catalyst was fed, and the temperature of the mixture was increased to 235° C. Then, the mixture was allowed to react under normal pressure (101.3 kPa) for 5 hours, and additionally, under reduced pressure (8 kPa) for 1 hour.

Next, the following polyhydric carboxylic acid monomers and polyhydric alcohol monomers were fed, and confirmation was made that the reaction system was uniformly stirred. After that, a catalyst, $Ti(O\text{-}n\text{-}Bu)_4$ (tetra-normal-butyl titanate in an amount of 0.003% by mass with respect to the total amount of the following polyhydric carboxylic acid monomers), was fed.

Polyhydric Carboxylic Acid Monomers

Terephthalic acid (TPA): 3.9 parts by mass

Fumaric acid (FA): 0.3 parts by mass

Polyhydric Alcohol Monomers 2,2-bis(4-hydroxyphenyl)propane ethylene oxide (2 mol) adduct (BPA-EO): 3.1 parts by mass 2,2-bis(4-hydroxyphenyl)propane propylene oxide (2 mol) adduct (BPA-PO): 9.8 parts by mass Furthermore, while distilling away generated water, the temperature of the mixture was increased from 190° C. to 240° C. in 6 hours, and a dehydration condensation reaction was continued to perform polymerization at 240° C. for another 6 hours, thereby obtaining a crystalline polyester resin (cm-6). The crystalline polyester resin (cm-6) had a weight average molecular weight (Mw) of 8,000 and a melting point (Tc) of 72° C.

<Preparation of Crystalline Resin (Crystalline Polyester Resin) Particle Dispersion Solution (CA-1)>

300 parts by mass of the crystalline polyester resin (cm-1) was melted, and delivered, while remaining molten, to an emulsion disperser "CAVITRON CD1010" (manufactured by Eurotec Co., Ltd.) at a delivery rate of 100 parts by mass per minute. In addition, simultaneously with the delivery of the molten crystalline polyester resin (cm-1), a diluted ammonia water having a concentration of 0.37% by mass prepared by diluting a reagent ammonia solution with ion-exchanged water in an aqueous solvent tank was delivered to the emulsion disperser at a delivery rate of 0.1 L per minute while being heated to 100° C. by a heat exchanger. Then, the emulsion disperser was operated under conditions: rotor rotation speed 60 Hz and pressure 5 $kg/cm^2$ to prepare a crystalline polyester resin particle dispersion solution (CA-1). Additionally, the diluted ammonia water was added so that the degree of neutralization became 45%. In the crystalline polyester resin particle dispersion solution (CA-1), crystalline polyester resin particles had a dispersion diameter of 203 nm in terms of volume-based median diameter.

<Preparation of Crystalline Polyester Resin Particle Dispersion Solutions (CA-2 to CA-6)>

Crystalline polyester resin particle dispersion solutions (CA-2 to CA-6) were prepared in the same manner as in the above <Preparation of Crystalline Polyester Resin Particle Dispersion Solution (CA-1)> except that the kind of the crystalline polyester resin was changed to any of the cm-2 to the cm-6. In the crystalline polyester resin particle dispersion solutions (CA-2 to CA-6), crystalline polyester resin particles had dispersion diameters of from 195 to 210 nm in terms of volume-based median diameter.

[Core Resin: Preparation of Amorphous Polyester Resin Dispersion Solution]

<Synthesis of Amorphous Polyester Resin (am-1)>

The following polyhydric carboxylic acid components and polyhydric alcohol components were fed into a reactor vessel equipped with a stirrer, a nitrogen introducing tube, a temperature sensor, and a rectification column, heated to 190° C. in 1 hour, and confirmation was made that the reaction system was uniformly stirred. After that, a catalyst, $Ti(O\text{-}n\text{-}Bu)_4$ (tetra-normal-butyl titanate in an amount of 0.003% by mass with respect to the total amount of the following polyhydric carboxylic acid monomers), was fed.

Furthermore, while distilling away generated water, the temperature of the mixture was increased from 190° C. to 240° C. in 6 hours, and a dehydration condensation reaction was continued to perform polymerization at 240° C. for another 6 hours, thereby obtaining an amorphous polyester resin (am-1).

Polyhydric Carboxylic Acid Components

Terephthalic acid (TPA): 30 parts by mass

Fumaric acid (FA): 2.1 parts by mass

Dodecenyl succinic acid (DDSA): 9.6 parts by mass

Polyhydric Alcohol Components 2,2-bis(4-hydroxyphenyl)propane ethylene oxide (2 mol) adduct (BPA-EO): 24 parts by mass 2,2-bis(4-hydroxyphenyl)propane propylene oxide (2 mol) adduct (BPA-PO): 76 parts by mass The amorphous polyester resin (am-1) had a weight average molecular weight (Mw) of 20,500 and a softening point (Tsp) of 103° C.

<Synthesis of Amorphous Polyester Resin (am-2)>

An amorphous polyester resin (am-2) was produced in the same manner as in the above <Synthesis of Amorphous Polyester Resin (am-1)> except that 9.6 parts by mass of dodecenyl succinic acid was changed to 9.1 parts by mass of decenyl succinic acid (DSA). The amorphous polyester resin (am-2) had a weight average molecular weight (Mw) of 25,000 and a softening point (Tsp) of 100° C.

<Synthesis of Amorphous Polyester Resin (am-3)>

An amorphous polyester resin (am-3) was produced in the same manner as in the above <Synthesis of Amorphous Polyester Resin (am-1)> except that dodecenyl succinic acid was not added. The amorphous polyester resin (am-3) had a weight average molecular weight (Mw) of 22,000 and a softening point (Tsp) of 98° C.

<Preparation of Amorphous Resin (Amorphous Polyester Resin) Particle Dispersion Solution (AA-1)>

300 parts by mass of the amorphous polyester resin (am-1) was melted, and delivered, while remaining molten, to an emulsion disperser "CAVITRON CD1010" (manufactured by Eurotec Co., Ltd.) at a delivery rate of 100 parts by mass per minute. In addition, simultaneously with the delivery of the molten amorphous polyester resin (am-1), a diluted ammonia water having a concentration of 0.37% by mass prepared by diluting a reagent ammonia solution with ion-exchanged water in an aqueous solvent tank was delivered to the emulsion disperser at a delivery rate of 0.1 L per minute while being heated to 100° C. by a heat exchanger. Then, the emulsion disperser was operated under conditions: rotor rotation speed 60 Hz and pressure 5 kg/cm$^2$ to prepare an amorphous polyester resin particle dispersion solution (AA-1). Additionally, the diluted ammonia water was added so that the degree of neutralization became 45%. In the amorphous polyester resin particle dispersion solution (AA-1), amorphous polyester resin particles had a dispersion diameter of 250 nm in terms of volume-based median diameter.

<Preparation of Amorphous Polyester Resin Particle Dispersion Solutions (AA-2 and AA-3)>

Amorphous polyester resin particle dispersion solutions (AA-2 and AA-3) were prepared in the same manner as in the above <Preparation of Amorphous Polyester Resin Particle Dispersion Solution (AA-1)> except that the kind of the amorphous polyester resin was changed to the am-2 or the am-3. In the amorphous polyester resin particle dispersion solutions (AA-2 and AA-3), amorphous polyester resin particles had dispersion diameters of 234 nm and 240 nm, respectively, in terms of volume-based median diameter.

Table 1 below shows properties of the crystalline polyester resins and the dispersion solutions thereof, and Table 2 below shows properties of the amorphous polyester resins and the dispersion solutions thereof, respectively.

[Shell Resin: Production of Hybrid Amorphous Vinyl Resin Particle Dispersion Solution]

<Synthesis of Hybrid Amorphous Vinyl Resin (vm-1)>

The following raw material monomers of a vinyl resin component and the following raw material monomers (polyhydric alcohol monomers) of a polycondensation resin component were placed in a 10 L-capacity four-necked flask equipped with a nitrogen introducing tube, a dewatering conduit, a stirrer, and a thermocouple:

n-Butyl acrylate (n-BA): 38.5 parts by mass

Acrylic acid (AA): 6.5 parts by mass

Polyhydric Alcohol Monomers 2,2-bis(4-hydroxyphenyl)propane ethylene oxide (2 mol) adduct (BPA-EO): 9.0 parts by mass 2,2-bis(4-hydroxyphenyl)propane propylene oxide (2 mol) adduct (BPA-PO): 28.4 parts by mass Next, the following initiator was added, and the mixture was heated to 100° C. Then, while maintaining the temperature, an addition polymerization reaction was performed for 5 hours:

Polymerization initiator (di-t-butyl peroxide): 6.7 parts by mass

After that, the following raw material acid monomers (polyhydric carboxylic acid monomers) of a polycondensation resin component were added:

Polyhydric Carboxylic Acid Monomers

Terephthalic acid (TPA): 11.2 parts by mass

Fumaric acid (FA): 0.8 parts by mass

Dodecenyl succinic acid (DDSA): 3.6 parts by mass

Trimellitic acid (TMA): 2.1 parts by mass

TABLE 1

| | | Polyhydric carboxylic acid component | | | Polyhydric alcohol component | | | Dispersion solution | |
|---|---|---|---|---|---|---|---|---|---|
| Resin No. | Dispersion solution No. | Kind | Number of carbon atoms | Amount of addition (parts by mass) | kind | Number of carbon atoms | Amount of addition (parts by mass) | Degree of neutralization (%) | Dispersion diameter (nm) |
| cm-1 | CA-1 | Dodecane dioic acid | 12 | 99.9 | 1,9-nonane diol | 9 | 70.4 | 45 | 203 |
| cm-2 | CA-2 | Tetradecane dioic acid | 14 | 99.9 | 1,9-nonane diol | 9 | 62.9 | 45 | 195 |
| cm-3 | CA-3 | Tetradecane dioic acid | 14 | 99.9 | 1,6-hexane diol | 6 | 46.6 | 45 | 200 |
| cm-4 | CA-4 | Sebacic acid | 10 | 99.9 | 1,9-nonane diol | 9 | 80.1 | 45 | 205 |
| cm-5 | CA-5 | Dodecane dioic acid | 12 | 89.9 | 1,9-nonane diol | 9 | 57.1 | 45 | 210 |
| cm-6 | CA-6 | Dodecane dioic acid | 12 | 89.9 | 1,9-nonane diol | 9 | 57.1 | 45 | 207 |

* cm-5 is a resin prepared by hybridizing a crystalline polyester polymerization segment with 10% by mass of a vinyl polymerization segment. (Crystalline polyester polymerization segment:vinyl polymerization segment = 90:10 (mass ratio))

* cm-6 is a resin prepared by hybridizing a crystalline polyester polymerization segment with 10% by mass of an amorphous polyester polymerization segment. (Crystalline polyester polymerization segment:amorphous polyester polymerization segment = 90:10 (mass ratio))

TABLE 2

| Resin | Dispersion solution | Polyhydric carboxylic acid component (parts by mass) | | | | Polyhydric alcohol component (parts by mass) | | | Softening point |
|---|---|---|---|---|---|---|---|---|---|
| No. | No. | TPA | FA | DDSA | DSA | BPA-EO | BPA-PO | Mw | (° C.) |
| am-1 | AA-1 | 30 | 2.1 | 9.6 | — | 24 | 76 | 20,500 | 103 |
| am-2 | AA-2 | 30 | 2.1 | — | 9. 1 | 24 | 76 | 25,000 | 100 |
| am-3 | AA-3 | 30 | 2.1 | — | — | 24 | 76 | 22,000 | 98 |

After that, a catalyst $Ti(O\text{-}n\text{-}Bu)_4$ (tetra-normal-butyl titanate in an amount of 0.003% by mass with respect to the total amount of the polyhydric carboxylic acid monomers), was added. Then, the temperature of the mixture was increased to 175° C., and the mixture was allowed to react for 10 hours, followed by additionally increasing the temperature thereof to 200° C. in 10 hours. Next, after decreasing the temperature to 180° C., trimellitic anhydride was added to allow the reaction mixture to react until it had an acid value of about 24 mgKOH/g, thereby producing a hybrid amorphous vinyl resin (vm-1) including a vinyl polymerization segment as a main chain and a polyester polymerization segment as a side chain.

<Synthesis of Hybrid Amorphous Vinyl Resins (vm-2 to vm-6)>

Hybrid amorphous vinyl resins (vm-2 to vm-6) were produced in the same manner as in the above <Hybrid Amorphous Vinyl Resin (vm-1)> except that the amounts of the monomer components of the amorphous polyester polymerization segment, the amounts of the monomer components of the vinyl polymerization segment, and the amount of the polymerization initiator were changed as shown in Table 3.

<Synthesis of Amorphous Polyester Resin (vm-8)>

The following polyhydric carboxylic acid monomers and polyhydric alcohol monomers were fed into a reactor vessel equipped with a stirrer, a nitrogen introducing tube, a temperature sensor, and a rectification column, heated to 190° C. in 1 hour, and confirmation was made that the reaction system was uniformly stirred. After that, a catalyst, $Ti(O\text{-}n\text{-}Bu)_4$ (tetra-normal-butyl titanate in an amount of 0.003% by mass with respect to the total amount of the polyhydric carboxylic acid monomers), was fed.

Furthermore, while distilling away generated water, the temperature of the mixture was increased from 190° C. to 240° C. in 6 hours, and a dehydration condensation reaction was continued to perform polymerization at 240° C. for another 6 hours, thereby obtaining an amorphous polyester resin (vm-8).

Polyhydric Carboxylic Acid Monomers
Terephthalic acid (TPA): 20.4 parts by mass
Fumaric acid (FA): 1.4 parts by mass
Dodecenyl succinic acid (DDSA): 6.5 parts by mass
Trimellitic acid (TMA): 3.8 parts by mass
Polyhydric Alcohol Monomers
2,2-bis(4-hydroxyphenyl)propane ethylene oxide (2 mol) adduct (BPA-EO): 16.3 parts by mass
2,2-bis(4-hydroxyphenyl)propane propylene oxide (2 mol) adduct (BPA-PO): 51.6 parts by mass <Synthesis of Hybrid Amorphous Vinyl Resin (vm-9)>

The following raw material monomers of a polycondensation resin component were placed in a 10 L-capacity four-necked flask equipped with a nitrogen introducing tube, a dewatering conduit, a stirrer, and a thermocouple, and heated to 170° C.:

Polyhydric Carboxylic Acid Monomers
Terephthalic acid (TPA): 9.8 parts by mass
Fumaric acid (FA): 0.7 parts by mass
Dodecenyl succinic acid (DDSA): 3.1 parts by mass
Trimellitic acid (TMA): 1.8 parts by mass
Polyhydric Alcohol Monomers
2,2-bis(4-hydroxyphenyl)propane ethylene oxide (2 mol) adduct (BPA-EO): 7.8 parts by mass
2,2-bis(4-hydroxyphenyl)propane propylene oxide (2 mol) adduct (BPA-PO): 24.8 parts by mass After that, a catalyst, $Ti(O\text{-}n\text{-}Bu)_4$ (tetra-normal-butyl titanate in an amount of 0.003% by mass with respect to the total amount of the polyhydric carboxylic acid monomers), was added. Then, the temperature of the mixture was increased to 175° C., and the mixture was allowed to react for 10 hours, followed by additionally increasing the temperature thereof to 200° C. in 10 hours. Next, after decreasing the temperature to 180° C., trimellitic anhydride was added to allow the reaction mixture to react until it had an acid value of about 24 mgKOH/g.

Next, the temperature of the reaction mixture was decreased to 100° C., and a mixture solution prepared by stirring and mixing the following raw material monomers of a vinyl resin component was added dropwise in 1 hour through a liquid feeding pump:

n-Butyl acrylate: 44.4 parts by mass
Acrylic acid: 7.6 parts by mass

While maintaining the temperature at 100° C., the following initiator was added, and an addition polymerization reaction was aged for 2 hours. Then, the raw material monomers of the vinyl resin component were removed at 8.3 kPa for 1 hour:

Polymerization initiator (di-t-butyl peroxide): 7.8 parts by mass

Thereby, a hybrid amorphous vinyl resin (vm-9) was produced that included a polyester polymerization segment as a main chain and a vinyl polymerization segment as a side chain.

<Preparation of Hybrid Amorphous Vinyl Resin Dispersion Solution (VD-1)>

300 parts by mass of the hybrid amorphous vinyl resin (vm-1) was melted, and delivered, while remaining molten, to an emulsion disperser "CAVITRON CD1010" (manufactured by Eurotec Co., Ltd.) at a delivery rate of 100 parts by mass per minute. In addition, simultaneously with the delivery of the molten hybrid amorphous vinyl resin (vm-1), a diluted ammonia water having a concentration of 0.37% by mass prepared by diluting a reagent ammonia solution with ion-exchanged water in an aqueous solvent tank was delivered to the emulsion disperser at a delivery rate of 0.1 L per minute while being heated to 100° C. by a heat exchanger. Then, the emulsion disperser was operated under conditions: rotor rotation speed 60 Hz and pressure 5 $kg/cm^2$ to prepare a hybrid amorphous vinyl resin particle dispersion solution (VD-1). Additionally, the diluted ammonia water was added so that the degree of neutralization became 45%. In the hybrid amorphous vinyl resin particle dispersion solution (VD-1), hybrid amorphous vinyl resin particles had a dispersion diameter of 225 nm in terms of volume-based median diameter.

<Preparations of Hybrid Amorphous Vinyl Resin Dispersion Solutions (VD-2 to VD-6 and VD-9) and Amorphous Polyester Resin Dispersion Solution (VD-8)>

Hybrid amorphous vinyl resin particle dispersion solutions (VD-2 to VD-6 and VD-9) and an amorphous polyester resin particle dispersion solution (VD-8) were prepared in the same manner as in the above <Preparation of Hybrid Amorphous Vinyl Resin Particle Dispersion Solution (VD-1)> except that the kinds of the hybrid amorphous vinyl resin and the amorphous polyester resin were changed to any of the vm-2 to vm-6, vm-9, and vm-8. In the hybrid amorphous vinyl resin particle dispersion solutions (VD-2 to VD-6 and VD-9) and the amorphous polyester resin particle dispersion solution (VD-8), hybrid amorphous vinyl resin particles and amorphous polyester resin particles had dispersion diameters of from 200 to 230 nm in terms of volume-based median diameter.

<Preparation of Amorphous Vinyl Resin Dispersion Solution (VD-7)>

A solution prepared by dissolving 5 parts by mass of sodium polyoxyethylene (2) dodecyl ether sulfate in 780 parts by mass of ion-exchanged water was fed into a reactor vessel equipped with a stirrer, a temperature sensor, a cooling tube, and a nitrogen introducing tube, and the internal temperature was increased to 80° C. while stirring the solution at a stirring rate of 230 rpm in a nitrogen gas stream. After increasing the temperature, a solution prepared by dissolving 0.47 parts by mass of potassium persulfate in 18 parts by mass of ion-exchanged water was added, and again, the temperature of the resulting solution was increased to 80° C. Then, a mixed solution of the following monomers was added dropwise in 1 hour. The obtained solution was heated at 80° C. for 2 hours, and then, polymerization was performed by stirring to prepare a dispersion solution (VD-7) of an amorphous vinyl resin (styrene-acrylic resin vm-7):

Styrene: 205 parts by mass n-Butyl acrylate: 100 parts by mass

Methacrylic acid: 18 parts by mass n-Octyl-3-mercapto propionate: 4.4 parts by mass Table 3 and Table 4 below show properties of the hybrid amorphous vinyl resins, the amorphous vinyl resin, the amorphous polyester resin, and the dispersion solutions thereof.

TABLE 4-continued

| | Mw | Tg (° C.) |
|---|---|---|
| vm-3 | 28,500 | 59 |
| vm-4 | 30,000 | 58 |
| vm-5 | 28,000 | 56 |
| vm-6 | 28,800 | 55 |
| vm-7 | 27,000 | 55 |
| vm-8 | 28,000 | 60 |
| vm-9 | 30,000 | 59 |

[Preparation of Release Agent Particle Dispersion Solution (W1)]

The following components were mixed together, and ester wax as a release agent was dissolved at an internal liquid temperature of 120° C. by a pressure discharge type homogenizer (a Gaulin homogenizer manufactured by Gaulin Co., Ltd). After that, the resulting mixture was subjected to a dispersion treatment at a dispersion pressure of 5 MPa for 120 minutes, and subsequently at 40 MPa for 360 minutes, and cooled down to obtain a release agent dispersion solution (W1). Particles in the release agent dispersion solution (W1) had a volume-based median diameter of 225 nm. Then, ion-exchanged water was added to adjust so that the dispersion solution (W1) had a solid content concentration of 20.0% by mass.

TABLE 3

| Resin No. | Dispersion solution No. | Amorphous polyester polymerization segment (parts by mass) | | | | | | Vinyl polymerization segment (parts by mass) | | | Shell resin | |
|---|---|---|---|---|---|---|---|---|---|---|---|---|
| | | TPA | FA | DDSA | TMA | BPA-EO | BPA-PO | n-BA | AA | Polymerization initiator | Kind | Vinyl polymerization segment content (% by mass) |
| vm-1 | VD-1 | 11.2 | 0.8 | 3.6 | 2.1 | 9.0 | 28.4 | 38.5 | 6.5 | 6.7 | Hybrid amorphous vinyl resin | 45 |
| vm-2 | VD-2 | 9.8 | 0.7 | 3.1 | 1.8 | 7.8 | 24.8 | 44.4 | 7.6 | 7.8 | Hybrid amorphous vinyl resin | 52 |
| vm-3 | VD-3 | 7.1 | 0.5 | 2.3 | 1.3 | 5.7 | 18.1 | 55.6 | 9.4 | 9.7 | Hybrid amorphous vinyl resin | 65 |
| vm-4 | VD-4 | 4.1 | 0.3 | 1.3 | 0.8 | 3.3 | 10.3 | 68.4 | 11.6 | 12.0 | Hybrid amorphous vinyl resin | 80 |
| vm-5 | VD-5 | 2.0 | 0.1 | 0.7 | 0.4 | 1.6 | 5.2 | 76.9 | 13.1 | 13.5 | Hybrid amorphous vinyl resin | 90 |
| vm-6 | VD-6 | 1.0 | 0.1 | 0.3 | 0.2 | 0.8 | 2.6 | 81.2 | 13.8 | 14.2 | Hybrid amorphous vinyl resin | 95 |
| vm-7 | VD-7 | — | — | — | — | — | — | Styrene-acrylic resin | | | Amorphous vinyl resin | 100 |
| vm-8 | VD-8 | 20.4 | 1.4 | 6.5 | 3.8 | 16.3 | 51.6 | — | — | — | Amorphous polyester resin | 0 |
| vm-9 | VD-9 | 9.8 | 0.7 | 3.1 | 1.8 | 7.8 | 24.8 | 44.4 | 7.6 | 7.8 | Hybrid amorphous vinyl resin | 52 |

TABLE 4

| | Mw | Tg (° C.) |
|---|---|---|
| vm-1 | 30,500 | 61 |
| vm-2 | 29,000 | 60 |

Ester wax (Ester type wax) (trade name: NISSAN ELECTOR (registered trademark) WEP-3, melting temperature Tw 73° C., manufactured by NOF Co., Ltd.): 270 parts by mass Anionic surfactant (NEOGEN (registered trademark) RK, amount of active ingredient: 60% by mass, manufactured by Dai-ichi Kogyo Seiyaku Co., Ltd.): 13.5 parts by mass (3.0% by mass of the active ingredient with respect to the release agent)

Ion-exchanged water: 21.6 parts by mass

[Preparation of Aqueous Dispersion Solution (Cy1) of Colorant Particles]

90 parts by mass of sodium dodecyl sulfate was added to 1600 parts by mass of ion-exchanged water. While stirring the obtained solution, 420 parts by mass of copper phthalocyanine (C.I. Pigment Blue 15:3) was gradually added, and next, the mixture solution was subjected to a dispersion treatment using a disperser "CLEAR MIX (registered trademark)" (manufactured by M Technique Co., Ltd.) to prepare an aqueous dispersion solution (Cy1) of colorant particles.

In the obtained aqueous dispersion solution (Cy1) of the colorant particles, the colorant particles had a volume-based median diameter of 110 nm.

[Production of Toner]

<Production of Toner 1>

(Aggregation and Fusion Step)

70 parts by mass (in terms of solid content) of "the amorphous polyester resin particle dispersion solution (AA-1)", 10 parts by mass (in terms of solid content) of "the crystalline polyester resin particle dispersion solution (CA-1)", 10 parts by mass (in terms of solid content) of "the release agent particle dispersion solution (W1)", and 5 parts by mass (in terms of solid content) of "the colorant particle dispersion solution (Cy1)" were fed into a 5 L stainless steel reactor equipped with a stirrer, a cooling tube, and a temperature sensor. Additionally, 500 parts by mass of ion-exchanged water was fed, and while stirring the mixture solution, the pH thereof was adjusted to 10 using 5 mol/L of aqueous sodium hydroxide solution. Next, while stirring, an aqueous magnesium chloride solution prepared by dissolving 40 parts by mass of magnesium chloride hexahydrate in 40 parts by mass of ion-exchanged water was added dropwise in 10 minutes. The internal temperature was increased to 75° C., and particle sizes were measured using MULTISIZER 3 (aperture diameter: 50 μm, manufactured by Beckman-Coulter Co., Ltd). At a time when the particle size reached 6.0 μm in terms of volume-based median diameter, 20 parts by mass (in terms of solid content) of "the hybrid amorphous vinyl resin particle dispersion solution (VD-2)" was added, and then, the obtained solution was maintained for 1 hour, followed by addition of an aqueous sodium chloride solution prepared by dissolving 160 parts by mass of sodium chloride in 640 parts by mass of ion-exchanged water. Furthermore, heating and stirring was continued, and, at a time when the particles had a mean circularity of 0.960 as measured by a flow-type particle image analyzer "FPIA-2100" (manufactured by Sysmex Corporation), the internal temperature was cooled to 25° C. at a cooling rate of 10° C./min to obtain a dispersion solution of "toner matrix particles 1".

(Washing and Drying)

The dispersion solution of the toner matrix particles 1 produced in the aggregation and fusion step was subjected to solid-liquid separation using a basket type centrifugal separator to form a wet cake of the toner matrix particles. The wet cake was washed with ion-exchanged water at 35° C. by the basket type centrifugal separator until the filtrate had an electric conductivity of 5 μS/cm. After that, the cake was transferred to "FLASH JET DRYER (manufactured by Seishin Enterprise Co., Ltd)" and dried until the amount of water became 0.5% by mass, thereby producing "toner matrix particles 1".

(External Additive Treatment Step)

1 part by mass of hydrophobic Silica (number average primary particle size: 12 nm) and 0.3 parts by mass of hydrophobic titania (number average primary particle size: 20 nm) were added with respect to 100 parts by mass of the above "toner matrix particles 1" and mixed together by a Henschel mixer to produce toner 1.

<Production of Toners 2 to 25>

Toners 2 to 25 were produced in the same manner as in the above <Production of Toner 1> except that the kinds and usage amounts of the amorphous polyester resin dispersion solution, the crystalline polyester resin dispersion solution, the hybrid amorphous vinyl resin dispersion solution, and the amorphous vinyl resin dispersion solution were changed to have compositions shown in Table 5 below.

Particle sizes of these toners were all in a range of from 5.8 to 6.5 μm and a mean circularity of from 0.958 to 0.965.

<Preparation of Developers 1 to 25>

Developers 1 to 25, respectively, were produced by adding a ferrite carrier having a volume mean particle size of 60 μm and coated with an acrylic resin to the toners 1 to 25 so that toner particles had a concentration of 6% by mass and mixing them together.

<Evaluation Method>

(Lower Limit Fixation Temperature)

In a full-color copier "bizhub PRO (registered trademark) C6501" (manufactured by Konica Minolta, Inc.), which is a commercially available multifunction printer, a fixation device was modified so that the surface temperature of a fixation heat roller was changeable in a range of from 80 to 210° C. in a normal temperature and normal humidity environment (temperature: 20° C., humidity: 50% RH). Then, the above developers 1 to 25, respectively, were charged into the copier. A fixation experiment for fixating a solid image having a toner deposition amount of 11 mg/10 $cm^2$ on Npi high-quality paper (basis weight: 128 $g/m^2$) manufactured by Nippon Paper Industries Co., Ltd. was repeatedly performed by changing a setting fixation temperature in such a manner as to increase from 80° C. to 150° C. in 5° C. increments.

Next, regarding printed matter obtained in the fixation experiment at each fixation temperature, a lowest surface temperature of a fixation upper belt at which no cold offset was visually observed was checked and designated as a lower limit fixation temperature to evaluate low temperature fixability. Lower limit fixation temperatures equal to or less than 155° C. allow for practicality.

(Dot Reproducibility (Image Quality Stability))

Using a full-color copier "bizhub PRO (registered trademark) C1100" (manufactured by Konica Minolta, Inc.), which is a commercially available multifunction printer, 10000 copies of an evaluation chart with a printing rate of 5% were continuously output in an A4 landscape orientation at a printing rate of 100 pieces per minute in an environment with 20° C. and 50% RH. One-dot/one-space image formation was performed in an A4 landscape format at an output resolution of 1200 dpi, and one out of every 1000 pieces printed was extracted to visually evaluate dot reproducibility thereon.

<<Evaluation Criteria>>

Rank 5: neither dot misalignment nor dot scattering was found in all the charts.

Rank 4: slight dot misalignment was found, but no dot scattering was present in enlarged observation after continuous printing of 8000 pieces.

Rank 3: slight dot misalignment was found, but no dot scattering was present in enlarged observation after continuous printing of 3000 pieces.

Rank 2: dot misalignment was found in enlarged observation at the stage of an initial printing.

Rank 1: dot misalignment and dot scattering were visually apparent.

Table 5 below shows the compositions and evaluation results of the toners 1 to 25 and the developers 1 to 25.

TABLE 5

| | | | Core | | Shell | | | | |
|---|---|---|---|---|---|---|---|---|---|
| | Toner No. | Developer No. | Amorphous polyester resin (APES) | Crystalline polyester resin (CPES) | Kind | Vinyl polymerization segment content (% by mass) | APES/CPES/Shell mass ratio | Lower limit fixation temperature | Dot reproducibility (Rank) |
| Ex. 1 | Toner 1 | Developer 1 | AA-1 | CA-1 | VD-2 | 52 | 70/10/20 | 142° C. | 3 |
| Ex. 2 | Toner 2 | Developer 2 | AA-1 | CA-1 | VD-3 | 65 | 70/10/20 | 140° C. | 4 |
| Ex. 3 | Toner 3 | Developer 3 | AA-1 | CA-1 | VD-4 | 80 | 70/10/20 | 138° C. | 5 |
| Ex. 4 | Toner 4 | Developer 4 | AA-1 | CA-1 | VD-5 | 90 | 70/10/20 | 142° C. | 4 |
| Ex. 5 | Toner 5 | Developer 5 | AA-1 | CA-1 | VD-6 | 95 | 70/10/20 | 144° C. | 3 |
| Ex. 6 | Toner 6 | Developer 6 | AA-1 | CA-1 | VD-4 | 80 | 78/2/20 | 155° C. | 5 |
| Ex. 7 | Toner 7 | Developer 7 | AA-1 | CA-1 | VD-4 | 80 | 76/4/20 | 154° C. | 5 |
| Ex. 8 | Toner 8 | Developer 8 | AA-1 | CA-1 | VD-4 | 80 | 54/26/20 | 138° C. | 4 |
| Ex. 9 | Toner 9 | Developer 9 | AA-1 | CA-1 | VD-4 | 80 | 49/31/20 | 138° C. | 3 |
| Ex. 10 | Toner 10 | Developer 10 | AA-1 | CA-1 | VD-4 | 80 | 84/12/4 | 143° C. | 3 |
| Ex. 11 | Toner 11 | Developer 11 | AA-1 | CA-1 | VD-4 | 80 | 60/9/31 | 145° C. | 3 |
| Ex. 12 | Toner 12 | Developer 12 | AA-2 | CA-1 | VD-4 | 80 | 70/10/20 | 152° C. | 4 |
| Ex. 13 | Toner 13 | Developer 13 | AA-3 | CA-1 | VD-4 | 80 | 70/10/20 | 154° C. | 3 |
| Ex. 14 | Toner 14 | Developer 14 | AA-1 | CA-2 | VD-4 | 80 | 70/10/20 | 153° C. | 4 |
| Ex. 15 | Toner 15 | Developer 15 | AA-1 | CA-3 | VD-4 | 80 | 70/10/20 | 155° C. | 3 |
| Ex. 16 | Toner 16 | Developer 16 | AA-1 | CA-4 | VD-4 | 80 | 70/10/20 | 153° C. | 3 |
| Ex. 17 | Toner 17 | Developer 17 | AA-1 | CA-5 | VD-4 | 80 | 70/10/20 | 141° C. | 3 |
| Ex. 18 | Toner 18 | Developer 18 | AA-1 | CA-6 | VD-4 | 80 | 70/10/20 | 140° C. | 4 |
| Ex. 19 | Toner 19 | Developer 19 | AA-1 | CA-1 | VD-9 | 52 | 70/10/20 | 140° C. | 3 |
| Comp Ex. 1 | Toner 20 | Developer 20 | AA-1 | CA-1 | VD-1 | 45 | 70/10/20 | 157° C. | 2 |
| Comp Ex. 2 | Toner 21 | Developer 21 | AA-1 | CA-1 | VD-7 | 100 | 70/10/20 | 160° C. | 1 |
| Comp Ex. 3 | Toner 22 | Developer 22 | AA-1 | CA-1 | VD-8 | 0 | 70/10/20 | 143° C. | 2 |
| Comp Ex. 4 | Toner 23 | Developer 23 | AA-1 | CA-1 | — | — | 87.5/12.5/0 | 135° C. | 1 |
| Comp Ex. 5 | Toner 24 | Developer 24 | AA-1 | — | VD-4 | 80 | 80/0/20 | 160° C. | 4 |
| Comp Ex. 6 | Toner 25 | Developer 25 | — | CA-1 | VD-4 | 80 | 0/80/20 | 150° C. | 1 |

The results of Table 5 above show that the use of the toners of the Examples have allowed for excellent results regarding low temperature fixability and image quality stability.

On the other hand, results on the toners of Comparative Examples 1 to 4 and Comparative Example 6 indicate that there was no improvement, particularly, in image quality stability. The toner of Comparative Example 5 shows a result that low temperature fixability cannot be ensured.

What is claimed is:

1. An electrostatic latent image developing core-shell type toner comprising at least a binder resin, the binder resin comprising a crystalline polyester resin, an amorphous polyester resin, and a hybrid amorphous vinyl resin in which a vinyl polymerization segment is chemically bonded to a polymerization segment other than the vinyl polymerization segment, a core portion of the toner comprising the crystalline polyester resin and the amorphous polyester resin, a shell portion of the toner comprising the hybrid amorphous vinyl resin, and the hybrid amorphous vinyl resin having a vinyl polymerization segment content of from 51 to 99% by mass, wherein the crystalline polyester resin comprises a hybrid crystalline polyester resin in which a crystalline polyester polymerization segment is chemically bonded to an amorphous polyester polymerization segment or a vinyl polymerization segment.

2. The electrostatic latent image developing core-shell type toner as claimed in claim 1, wherein the hybrid amorphous vinyl resin has a vinyl polymerization segment content of from 65 to 90% by mass.

3. The electrostatic latent image developing core-shell type toner as claimed in claim 1, wherein the polymerization segment other than the vinyl polymerization segment is a polyester polymerization segment.

4. The electrostatic latent image developing core-shell type toner as claimed in claim 1, wherein the hybrid amorphous vinyl resin is a hybrid amorphous vinyl resin that comprises the vinyl polymerization segment as a main chain and the polymerization segment other than the vinyl polymerization segment as a side chain.

5. The electrostatic latent image developing core-shell type toner as claimed in claim 1, wherein the crystalline polyester resin further comprises an unmodified crystalline polyester resin.

6. The electrostatic latent image developing core-shell type toner as claimed in claim 1, wherein the binder resin has a crystalline polyester resin content of from 3 to 30% by mass.

7. The electrostatic latent image developing core-shell type toner as claimed in claim 1, wherein the binder resin has a crystalline polyester resin content of from 5 to 25% by mass.

8. The electrostatic latent image developing core-shell type toner as claimed in claim 1, wherein the binder resin has a hybrid amorphous vinyl resin content of from 5 to 30% by mass.

9. The electrostatic latent image developing core-shell type toner as claimed in claim 1, wherein the amorphous polyester resin comprises an unsaturated aliphatic polyhydric carboxylic acid component.

10. The electrostatic latent image developing core-shell type toner as claimed in claim 1, wherein the total number of carbon atoms of a polyhydric alcohol component constituting the crystalline polyester polymerization segment and carbon atoms of a polyhydric carboxylic acid component constituting the crystalline polyester polymerization segment is an odd number.

11. The electrostatic latent image developing core-shell type toner as claimed in claim 1, wherein an absolute value of a difference between the number of carbon atoms of a polyhydric alcohol component and the number of carbon atoms of a polyhydric carboxylic acid component constituting the crystalline polyester polymerization segment is equal to or more than 3.

12. A method for manufacturing an electrostatic latent image developing core-shell type toner comprising at least a binder resin that comprises a crystalline polyester resin, an amorphous polyester resin, and a hybrid amorphous vinyl resin in which a vinyl polymerization segment is chemically bonded to a polymerization segment other than the vinyl polymerization segment, the method comprising the steps of:

forming core particles by mixing a dispersion solution of particles of the crystalline polyester resin with a dispersion solution of particles of the amorphous polyester resin and aggregating and fusing the particles of the crystalline polyester resin and the particles of the amorphous polyester resin together; and forming a shell portion by adding a dispersion solution of particles of the hybrid amorphous vinyl resin in the dispersion solution comprising the core particles and aggregating and fusing the particles of the hybrid amorphous vinyl resin onto surfaces of the core particles whereby the toner of claim 1 is manufactured;

wherein the hybrid amorphous vinyl resin has a vinyl polymerization segment content of from 51 to 99% by mass, and wherein the crystalline polyester resin comprises a hybrid crystalline polyester resin in which a crystalline polyester polymerization segment is chemically bonded to an amorphous polyester polymerization segment or a vinyl polymerization segment.

13. An image forming method comprising a fixation step of fixating an image formed by an electrostatic latent image developing core-shell type toner that comprises at least a binder resin onto an image support member by a fixation treatment using a thermal compression fixation method, wherein the electrostatic latent image developing core-shell type toner is the electrostatic latent image developing core-shell type toner according to claim 1; and wherein a fixating member used in the fixation step comprises a plurality of layers comprising an elastic layer having a thickness of from 50 to 300 μm.

* * * * *